US012030108B2

(12) United States Patent
Nishizawa et al.

(10) Patent No.: US 12,030,108 B2
(45) Date of Patent: Jul. 9, 2024

(54) MANUFACTURING APPARATUS FOR HEAT DISSIPATION FINS

(71) Applicant: HIDAKA SEIKI KABUSHIKI KAISHA, Tokyo (JP)

(72) Inventors: Junichi Nishizawa, Tokyo (JP); Keiichi Morishita, Tokyo (JP)

(73) Assignee: HIDAKA SEIKI KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 18/277,871

(22) PCT Filed: Jun. 14, 2021

(86) PCT No.: PCT/JP2021/022556
§ 371 (c)(1),
(2) Date: Aug. 18, 2023

(87) PCT Pub. No.: WO2022/264223
PCT Pub. Date: Dec. 22, 2022

(65) Prior Publication Data
US 2024/0131573 A1 Apr. 25, 2024

(51) Int. Cl.
*B21D 53/02* (2006.01)

(52) U.S. Cl.
CPC ..... *B21D 53/022* (2013.01)

(58) Field of Classification Search
CPC ..... B21D 53/022; B21D 53/025; B21D 53/04
See application file for complete search history.

(56) References Cited

U.S. PATENT DOCUMENTS

2014/0090238 A1 4/2014 Karasawa et al.

FOREIGN PATENT DOCUMENTS

| | | | |
|---|---|---|---|
| JP | 10-263733 | A | 10/1998 |
| JP | 2014-73510 | A | 4/2014 |
| WO | WO2020/152736 | A1 | 7/2020 |

OTHER PUBLICATIONS

International Search Report (PCT/ISA/210) issued in PCT/JP2021/022556, dated Aug. 17, 2021.

*Primary Examiner* — Jason L Vaughan
(74) *Attorney, Agent, or Firm* — Birch, Stewart, Kolasch & Birch, LLP

(57) ABSTRACT

A manufacturing apparatus for heat dissipation fins can stably operate a stacker apparatus when stacking and collecting heat dissipation fins. Drop guide blades are provided above a holding apparatus for the heat dissipation fins disposed downstream of a cutoff apparatus that cuts a heat dissipation fin molding formed by a press apparatus into heat dissipation fins. When a stacker apparatus receives a heat dissipation fin from the holding apparatus, the drop guide blades approach the stacker apparatus and the heat dissipation fin is stacked and collected in the stacker apparatus by dropping to the stacker apparatus while being guided by the drop guide blades. After collecting the heat dissipation fins, only lowering operations of the stacker apparatus are performed.

18 Claims, 18 Drawing Sheets

MANUFACTURING APPARATUS FOR HEAT DISSIPATION FINS

TECHNICAL FIELD

The present invention relates to a manufacturing apparatus for heat dissipation fins which is used to manufacture heat dissipation fins used in a heat exchanger.

BACKGROUND ART

In a heat exchanger such as an air conditioner, a plurality of heat dissipation fins 30, in which a plurality of cutout portions 34 for inserting heat exchanging tubes 32 are formed as depicted in FIGS. 20A and 20B, are stacked in a state where the heat exchanging tubes 32 have been inserted through the heat dissipation fins 30. These heat dissipation fins 30 can be manufactured by a manufacturing apparatus for heat dissipation fins like that depicted in FIG. 19.

The manufacturing apparatus for heat dissipation fins 100 is provided with an uncoiler 40 in which a thin plate 10 made of metal, such as aluminum, is wound in a coil. The thin plate 10 pulled out from the uncoiler 40 through a loop controller 42 is passed through an NC feeder 44 and is intermittently supplied in constant lengths to a mold apparatus 46 provided inside a press apparatus 48. Note that although not depicted, it is also possible to provide an oil supplying unit for supplying machining oil to the surface of the thin plate 10 before the thin plate 10 is supplied to the mold apparatus 46.

The mold apparatus 46 is internally provided with an upper die set 46A that can move up and down and a lower die set 46B that is stationary. This mold apparatus 46 forms a metal strip 11 in which heat dissipation fin moldings 31 (that is, heat dissipation fins 30) like that depicted in FIGS. 20A and 20B are continuously formed in the width direction and the length direction (see FIG. 2). This metal strip 11 is formed into the heat dissipation fin moldings 31 by being divided by an inter-row slit apparatus 52 into product widths in a width direction, which is perpendicular on a horizontal plane to the conveying direction. After the heat dissipation fin moldings 31 have been fed out to a holder apparatus 70, the heat dissipation fin moldings 31 are cut by a cutoff apparatus 60 into predetermined lengths in the conveying direction, which divides the heat dissipation fin moldings 31 into the heat dissipation fins 30. After this, heat dissipation fins 30 are stacked and housed in a stacker apparatus 80 on which stacker pins SP are erected.

The heat dissipation fins 30 formed in this way are formed with a plurality of cutout portions 34 into which the heat exchange tubes 32 are inserted, and are provided with plate-like portions 36, on which louvers 35 are formed, formed between the cutout portions 34. The cutout portions 34 are formed from only one side in the width direction of the heat dissipation fins 30. Accordingly, the plurality of plate-like portions 36 between the cutout portions 34 are connected by a connecting portion 38 that extends along the length direction.

The configuration of a manufacturing apparatus for heat dissipation fins 100 including a stacker apparatus 80 that is suited to stacking and housing such heat dissipation fins 30 has been conceived by the present applicant, and a specific configuration of a stacker apparatus 80 is disclosed in Patent Literature 1 (International Publication No. WO2020/152736A1).

CITATION LIST

Patent Literature

Patent Literature 1
International Publication No. WO2020/152736A1

SUMMARY OF INVENTION

Technical Problem

The stacker apparatus 80 of the manufacturing apparatus for heat dissipation fins 100 disclosed in Patent Literature 1 uses a configuration where the stacker apparatus 80 is raised from below the holding apparatus 70 for the heat dissipation fins 30, which is disposed adjacent to and on the downstream side of the cutoff apparatus 60, to stack and collect the heat dissipation fins 30 from the holding apparatus 70 (the overall configuration is not illustrated). In other words, a problem has become clear in that the operation of the stacker apparatus 80 becomes unstable when the stacker apparatus 80 is raised due to the increase in weight that accompanies an increase in the number of stacked heat dissipation fins 30.

Solution to Problem

For this reason, the present invention was conceived to solve the above problem and has the following object. That is, it is an object of providing a manufacturing apparatus for heat dissipation fins which, when the stacker apparatus of the manufacturing apparatus for heat dissipation fins stacks and collects the heat dissipation fins, is capable of stabilizing operations of the stacker apparatus, even when the stacked number of the heat dissipation fins rises and the weight increases, by performing only lowering operations when the heat dissipation fins are stacked and collected on the stacker apparatus.

As a result of investigating the problem described above, the present inventors conceived the following configuration. That is, a manufacturing apparatus for heat dissipation fins according to the present invention includes: a press apparatus provided with a mold apparatus that forms cutout portions in unmachined metal thin plate, which has been supplied from a material supplying unit, to form a heat dissipation fin molding; a conveying apparatus that supplies the thin plate to the press apparatus and conveys the heat dissipation fin molding from the press apparatus; a cut-off apparatus that cuts the heat dissipation fin molding into a predetermined length to form a heat dissipation fin; a holder apparatus including: a pair of holders that hold the heat dissipation fin molding and the heat dissipation fin and are capable of moving together and apart between positions to a side of the heat dissipation fin molding, which has passed through the cutoff apparatus and protrudes in a conveying direction from the cutoff apparatus, and holding positions for holding the heat dissipation fin molding; and a holder opening/closing mechanism that moves the pair of holders together and apart; a stacker apparatus that is disposed below the holder apparatus to stack heat dissipation fins that have been cut into a predetermined length by the cutoff apparatus and includes: a stacker guide holder unit on which a stacker guide, which is inserted through the heat dissipation fin held by the holder apparatus, is erected; a fin receiving portion that contacts a lower surface of a lowest heat dissipation fin out of the plurality of heat dissipation fins through which the stacker guide passes through; and a moving mechanism that moves the fin receiving portion along the stacker guide; a drop guide apparatus including a drop guide disposed above the pair of holders at a position on a plane that enables the drop guide to be inserted into one of the cutout portions; and a drop guide moving unit that moves the drop guide toward and away from the stacker apparatus; and an operation control unit that controls respective operations of at least the cutoff apparatus, the holder apparatus, the stacker apparatus, and the drop guide apparatus.

By using the above configuration, it is possible, when stacking and collecting the heat dissipation fins in the stacker apparatus, to move the drop guide toward and away from the stacker apparatus from the above the stacker apparatus to guide the dropping of the heat dissipation fins. By doing so, the stacker apparatus does not need to be inserted into the heat dissipation fins from below the heat dissipation fins, which eliminates the need to move the stacker apparatus up and down. That is, when the stacker apparatus stacks and collects the heat dissipation fins, the stacker apparatus is raised only in an empty state, and is moved only downward in a state where the heat dissipation fins have been stacked and accommodated. Accordingly, even if the number of stacked heat dissipation fins in the stacker apparatus increases, the stacker apparatus can still be operated in a stable state.

Conventionally, heat dissipation fins are stacked and collected by raising a stacker apparatus from below toward the heat dissipation fins, which makes it necessary to make stacker pins thin for positioning purposes and results in low rigidity for the stacker pins. Accordingly, a stacker apparatus has been unstable when handling a stack of heat dissipation fins produced by stacking on the stacker apparatus. According to the present invention, since the stacker pins of the stacker apparatus can be made thicker, it is possible to stably handle a stack of heat dissipation fins produced by stacking in the stacker apparatus.

It is also preferable for the operation control unit to execute: a first process that operates, when the pair of holders are at holding positions where the heat dissipation fin molding can be held, the moving mechanism to raise the fin receiving portion to a receiving height position for a heat dissipation fin; a second process that operates the conveying apparatus to cause the predetermined length of the heat dissipation fin molding to pass through the cutoff apparatus; a third process that operates the drop guide moving unit to insert the drop guide through a cutout portion in the heat dissipation fin molding and place a lower end portion of the drop guide close to an upper end portion of the stacker guide until the heat dissipation fin molding held by the pair of holders is cut by the cutoff apparatus into the heat dissipation fin; a fourth process that cuts the heat dissipation fin molding into a predetermined size using the cutoff apparatus; a fifth process that operates the holder opening/closing mechanism to move the pair of holders apart to transfer the heat dissipation fin along the drop guide onto the fin receiving portion; a sixth process that operates, after the heat dissipation fin has been transferred onto the fin receiving portion from the pair of holders, the drop guide moving unit to withdraw the lower end portion of the drop guide to a position above the pair of holders; and a seventh process that operates the moving mechanism to lower the fin receiving portion to a preset height.

It is also preferable for the operation control unit to execute: a first process of operating the conveying apparatus, when the pair of holders are at holding positions where the heat dissipation fin molding can be held, to cause the predetermined length of the heat dissipation fin molding to pass through the cutoff apparatus; a second process of operating the moving mechanism to raise the fin receiving portion to a receiving height position for a heat dissipation fin; a third process that operates the drop guide moving unit to insert the drop guide through a cutout portion in the heat dissipation fin molding and place a lower end portion of the drop guide close to an upper end portion of the stacker guide until the heat dissipation fin molding held by the pair of holders is cut by the cutoff apparatus into the heat dissipation fin; a fourth process that cuts the heat dissipation fin molding into a predetermined size using the cutoff apparatus; a fifth process that operates the holder opening/closing mechanism to move the pair of holders apart to transfer the heat dissipation fin along the drop guide onto the fin receiving portion; a sixth process that operates, after the heat dissipation fin has been transferred onto the fin receiving portion from the pair of holders, the drop guide moving unit to withdraw the lower end portion of the drop guide to a position above the pair of holders; and a seventh process that operates the moving mechanism to lower the fin receiving portion to a preset height.

By using the above configurations, it is possible to minimize operations of various components when stacking and collecting heat dissipation fins in the stacker apparatus.

It is also preferable for the operation control unit to execute, at or after execution of the sixth process, an eighth process that operates the holder opening/closing mechanism to return the pair of holders to the holding positions and preferable for the operation control unit to return, after execution of the eighth process, to the first process and repeatedly execute the first process to the eighth process for a preset number of iterations.

According to the above configuration, it is possible to continuously perform a process of stacking heat dissipation fins in the stacker apparatus.

It is preferable for the operation control unit to execute the first process and the second process simultaneously.

According to the above configuration, it is possible to shorten the takt time when manufacturing heat dissipation fins.

The stacker guide preferably includes a stacker blade that is inserted through a cutout portion and a stacker pin that contacts an outer edge of the heat dissipation fin, the drop guide is preferably a drop guide blade that is inserted through the cutout portion, and the drop guide moving unit preferably moves the drop guide blade toward and away from the stacker apparatus.

According to the above configuration, it is possible to prevent the heat dissipation fin from fluctuating when the heat dissipation fin held by the holder is dropped into the stacker apparatus and to further prevent the heat dissipation fin from becoming deformed during stacking.

It is preferable for the drop guide to include a drop guide pin that is provided at a position which is capable of contacting or at a predetermined interval from an outer edge of the heat dissipation fin.

According to the above configuration, it is possible to prevent a heat dissipation fin that was held by the holders from moving together with the holders when the holders are moved apart, which makes it possible to keep the heat dissipation fin positioned with respect to the stacker apparatus.

It is preferable to further include a stripper that prevents a heat dissipation fin from being raised together with the drop guide when the drop guide is moved away from the stacker apparatus.

By doing so, it is possible to prevent the heat dissipation fin placed on the fin receiving portion from being lifted as the drop guide is raised, which prevents the loaded state of the heat dissipation fin on the fin receiving portion from being disturbed.

Advantageous Effects of Invention

With the configuration of the manufacturing apparatus for heat dissipation fins according to the present invention, when the stacker apparatus of the manufacturing apparatus for heat dissipation fins is raised as part of the stacker apparatus stacking and collecting a heat dissipation fin, the stacker apparatus is placed in an empty state and the stacker apparatus is moved only downwards in a state where heat dissipation fins have been stacked and collected. Accordingly, the stacker apparatus can be operated in a stable state, even when the number of heat dissipation fins stacked on the stacker apparatus rises and the weight of the stacked fins increases. In addition, since the stacker pins of the stacker apparatus can be made thicker, the stack of heat dissipation fins stacked and collected in the stacker apparatus can be handled in a stable state.

DESCRIPTION OF EMBODIMENTS

Figure 1:
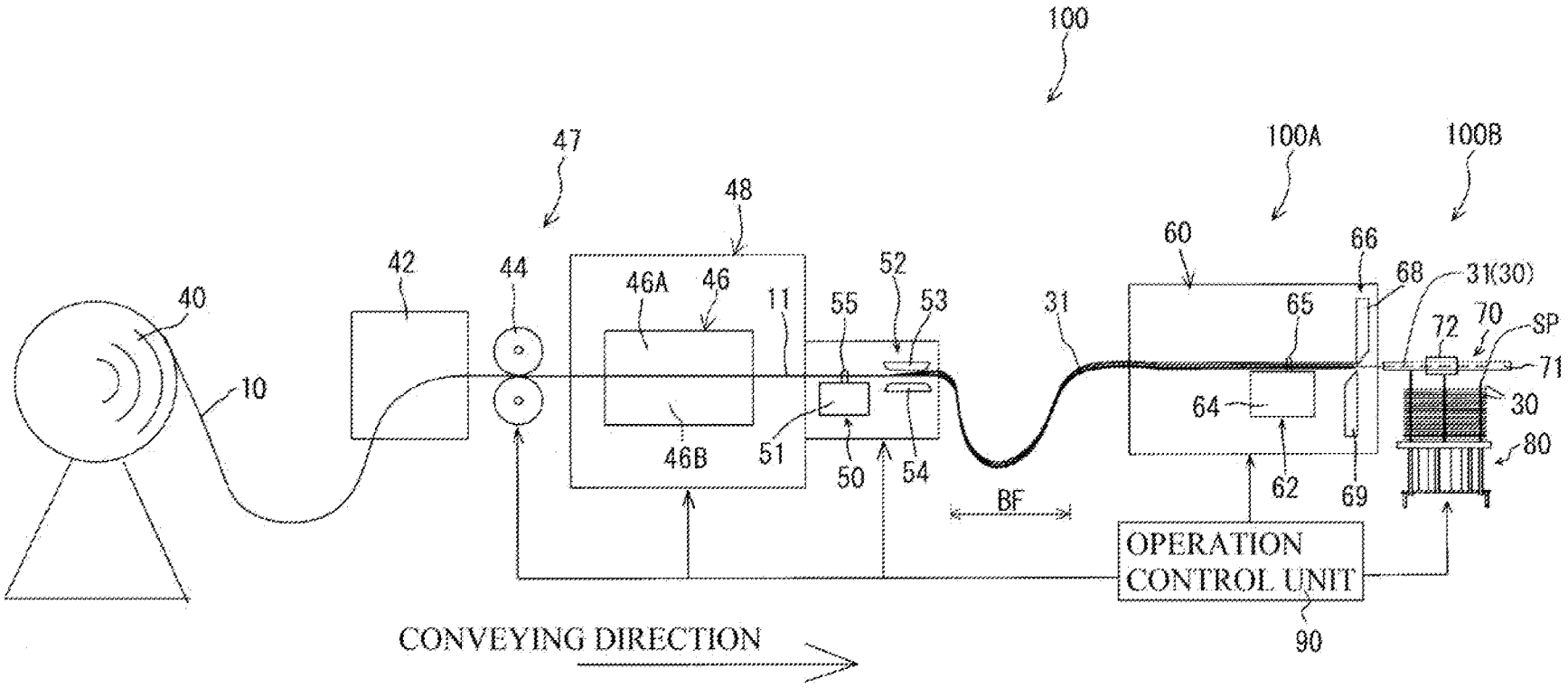
FIG. 1 is a side view schematically depicting the overall configuration of a manufacturing apparatus for heat dissipation fins according to the present invention.

FIG. 1 schematically depicts the overall configuration of a manufacturing apparatus for heat dissipation fins 100 according to an embodiment. The manufacturing apparatus for heat dissipation fins 100 according to the present embodiment can be roughly divided into a fin forming unit 100A and a stacker unit 100B. The fin forming unit 100A includes a material supplying unit 47, a press apparatus 48, a feeder apparatus 50, an inter-row slit apparatus 52 and a cutoff apparatus 60. The stacker unit 100B includes a holder apparatus 70 and a stacker apparatus 80.

Control of the operations of each component in the manufacturing apparatus for heat dissipation fins 100 according to the present embodiment is performed by an operation control unit 90 including at least an operation control program, which is stored in advance in a storage unit, and a CPU, which operates based on the operation control program. Aside from a configuration that is incorporated within the manufacturing apparatus for heat dissipation fins 100, the operation control unit 90 can be realized by a personal computer or the like provided separately from the manufacturing apparatus for heat dissipation fins 100. Since this is well known, detailed description is omitted here.

The material supplying unit 47 in the fin forming unit 100A includes an uncoiler 40, a loop controller 42, and an NC feeder 44. Unmachined thin metal plate 10 (hereinafter referred to simply as the "thin plate 10"), which is made of aluminum or the like and is the material of the heat dissipation fins 30, is wound in a coil in the uncoiler 40. The thin plate 10 pulled out from the uncoiler 40 is inserted into the loop controller 42, with the loop controller 42 suppressing any fluttering of the thin plate 10 that is intermittently fed. The NC feeder 44 is provided downstream of the loop controller 42. The NC feeder 44 is composed of two rollers which are in contact with the upper surface and the lower surface of the thin plate 10, and when the two rollers are rotationally driven, the thin plate 10 is sandwiched between the rollers and intermittently fed in constant lengths.

The press apparatus 48, which has the mold apparatus 46 disposed inside, is provided on the downstream side of the NC feeder 44. The mold apparatus 46 is provided with an upper die set 46A that can move up and down and a lower die set 46B that is stationary. Note that the thin plate 10 is supplied to the press apparatus 48 after oil has been applied to the surface by an oil supplying unit (not illustrated).

Figure 2:
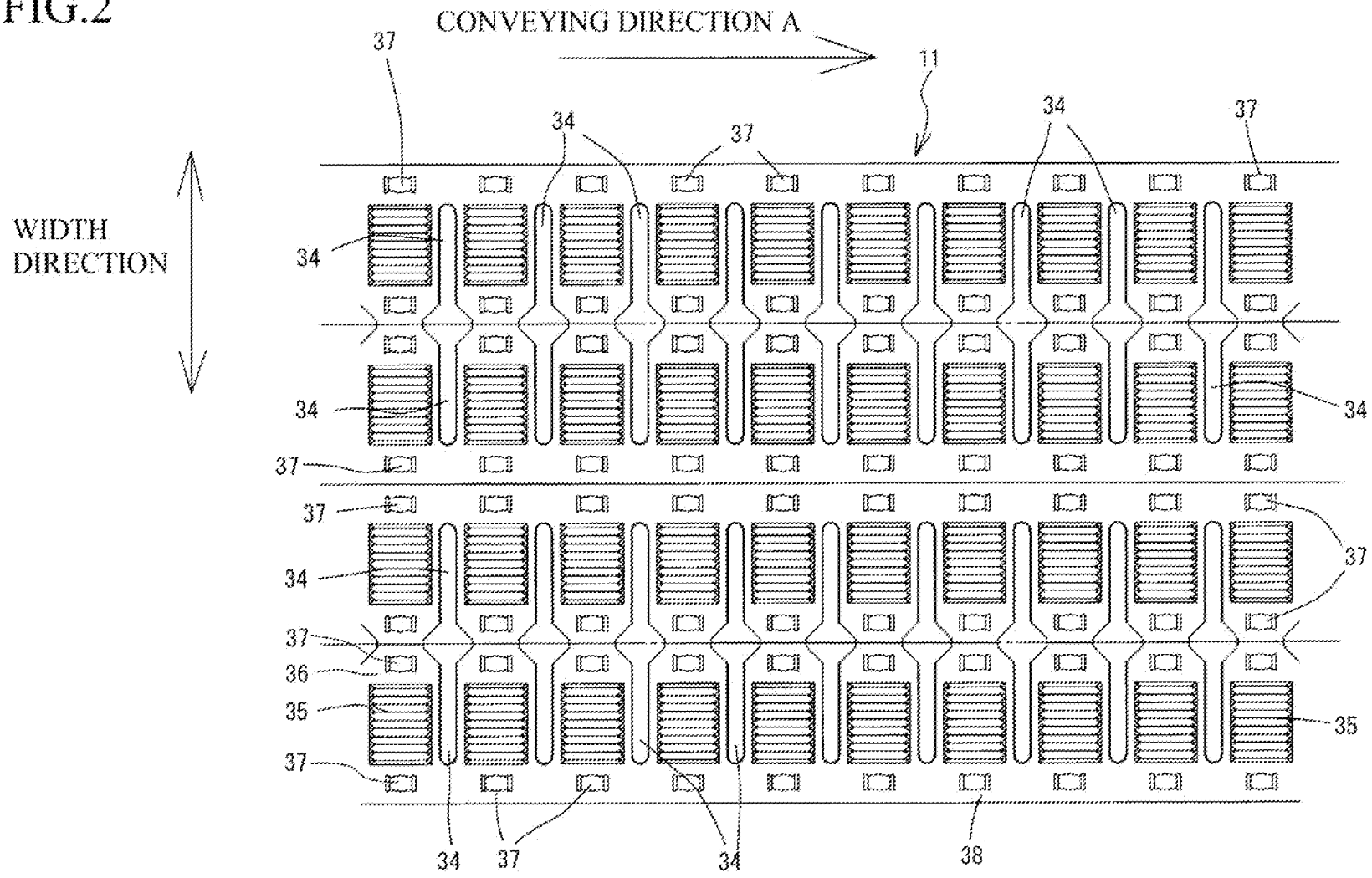
FIG. 2 is a plan view of a metal strip that has been machined by a mold apparatus in FIG. 1.

As depicted in FIG. 2, a metal strip 11 formed by the press apparatus 48 has a plurality of products aligned in a product width direction that is perpendicular to the arrow A, which indicates the conveying direction. The heat dissipation fins 30, which are specific products obtained by appropriately dividing the metal strip 11 in the width direction and the conveying direction, are formed with a plurality of cutout portions 34, into which flattened heat exchanging tubes 32 are inserted, formed at a plurality of locations. A plate-like portion 36 including a louver 35 is formed between each pair of cutout portions 34. Openings 37 are formed at both ends in the width direction of each louver 35 by cutting and lifting the thin metal plate 10. Of the two openings 37 for one louver 35, the opening 37 on one side is formed at a front end of the plate-like portion 36.

The cutout portions 34 are formed from only one side in the width direction of the heat dissipation fins 30. Accordingly, the plurality of plate-like portions 36 between the cutout portions 34 are connected by a connecting portion 38 that continuously extends along the length direction. Out of the two openings 37 for one louver 35, the opening 37 on the other side is formed on this connecting portion 38.

On the metal strip 11 depicted in FIG. 2, products are formed in a plurality of pairs in which two products are disposed facing each other so that the open ends of the cutout portions 34 are adjacent. In other words, pairs of two products in which the opening ends of the cutout portions 34 face each other are disposed in a state where the connecting portions 38 are adjacent to each other. Although the metal strip 11 in the present embodiment is formed with six pairs (that is, 12 products) of heat dissipation fin moldings 31 (not illustrated), the metal strip 11 is not limited to this configuration.

The description will now return to the overall configuration of the manufacturing apparatus for heat dissipation fins 100. As depicted in FIG. 1, the metal strip 11 formed by the mold apparatus 46 inside the press apparatus 48 is intermittently fed in the conveying direction by a feeder apparatus 50 provided downstream of the press apparatus 48. The feed timing of the feeder apparatus 50 is set by the operation control unit 90 so as to operate in conjunction with the NC feeder 44 and press operations by the press apparatus 48, which makes stable intermittent feeding possible.

In the feeder apparatus 50 according to the present embodiment, a reciprocating unit 51 capable of moving in the horizontal direction is controlled by the operation control unit 90 so as to reciprocally move between an initial position and a transfer position and thereby pull the metal strip 11 from the press apparatus 48. Feed pins 55 are disposed on an upper surface of the reciprocating unit 51 so as to protrude upward. The feed pins 55 advance from below into the cutout portions 34 or the openings 37 formed in the metal strip 11 and pull the metal strip 11, thereby moving the metal strip 11 to the transfer position. In the present embodiment, the material supplying unit 47 and the feeder apparatus 50 construct a "conveying apparatus" as defined in the patent claims. Note that a feeder apparatus 62, which will be described later, can also be added to this conveying apparatus.

An inter-row slit apparatus 52 is provided at a position that is adjacent to the feeder apparatus 50 on the downstream side. The inter-row slit apparatus 52 includes upper blades 53 disposed on the upper surface side of the metal strip 11 and lower blades 54 disposed on the lower surface side of the metal strip 11. The inter-row slit apparatus 52 may be provided so as to operate using up-down operations of the press apparatus 48. The operation of the inter-row slit apparatus 52 can be controlled by controlling the operation of the driving mechanism of the inter-row slit apparatus 52, not illustrated, using the operation control unit 90. The upper blades 53 and the lower blades 54 are formed so as to extend along the conveying direction of the metal strip 11. The upper blade 53 and the lower blade 54 are brought together to cut the metal strip 11 that is fed intermittently into predetermined widths, thereby manufacturing heat dissipation fin moldings 31 of the product width that are lengthy in the conveying direction.

The heat dissipation fin moldings 31 cut by the inter-row slit apparatus 52 are fed into cutoff apparatuses 60 that are provided separately for each heat dissipation fin molding 31. Note that before being fed into the cutoff apparatuses 60, the plurality of heat dissipation fin moldings 31 are disposed so that adjacent heat dissipation fin moldings 31 are spaced apart at a predetermined interval. In addition, before being fed into the cutoff apparatuses 60, the plurality of heat dissipation fin moldings 31 are allowed to sag downward so as to temporarily hold a longer length than the length of one feeding operation by the cutoff apparatus 60 and thereby form a buffer part BF.

A feeder apparatus 62 is provided inside each cutoff apparatus 60 for intermittently conveying a heat dissipation fin molding 31 in the conveying direction. The feeder apparatus 62 is constructed so that the length of one feeding operation can be set longer than the construction of the feeder apparatus 50 provided on the downstream side of the press apparatus 48. The operation of each feeder apparatus 62 is also controlled by the operation control unit 90, so that a conveying unit 64 that is capable of movement in the horizontal direction moves a predetermined distance to pull a heat dissipation fin molding 31 from the press apparatus 48 side and push out the molding 31 toward the downstream side of the cutoff apparatus 60. On the upper surface of each conveying unit 64, a plurality of rows of feed pins 65, which are aligned in the horizontal direction corresponding to the number of the heat dissipation fin moldings 31, are disposed so as to protrude upward in rows. These feed pins 65 advance from below into the cutout portions 34 or the openings 37 formed in the respective heat dissipation fin moldings 31 and pull the heat dissipation fin moldings 31 and thereby move the heat dissipation fin moldings 31 to the transfer position.

Figure 3:
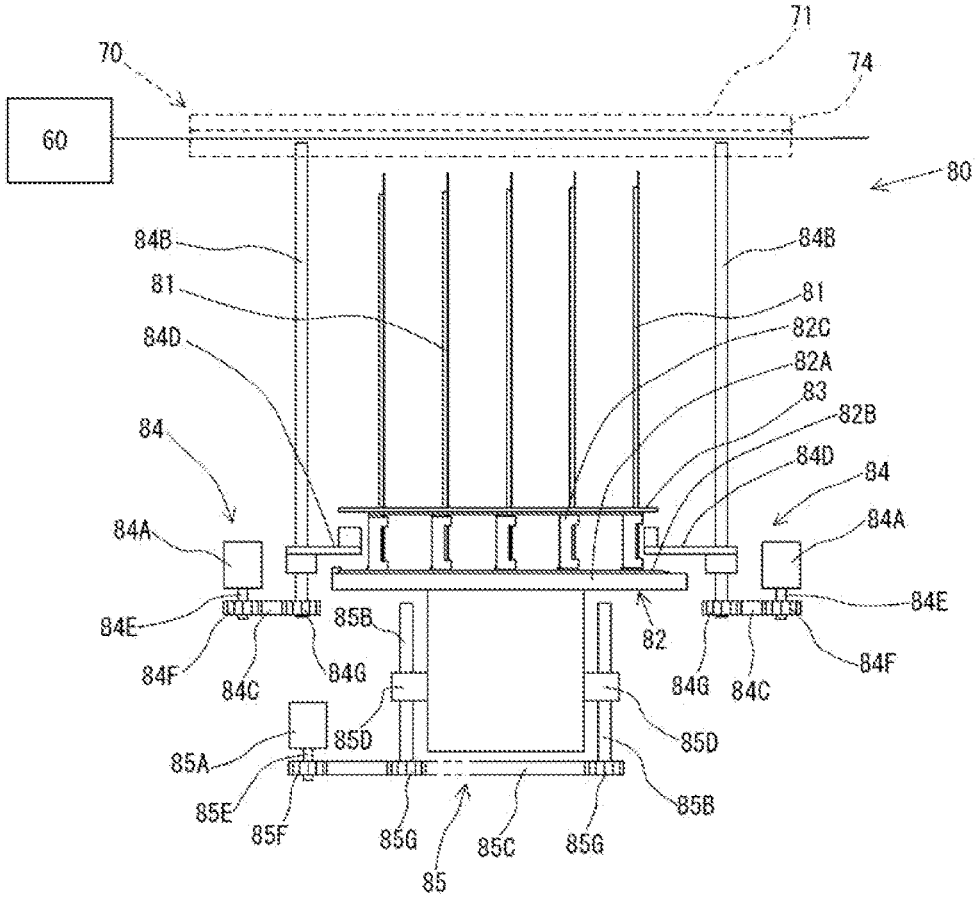
FIG. 3 is a side view of a holding apparatus and stacker apparatus part.
Figure 4:
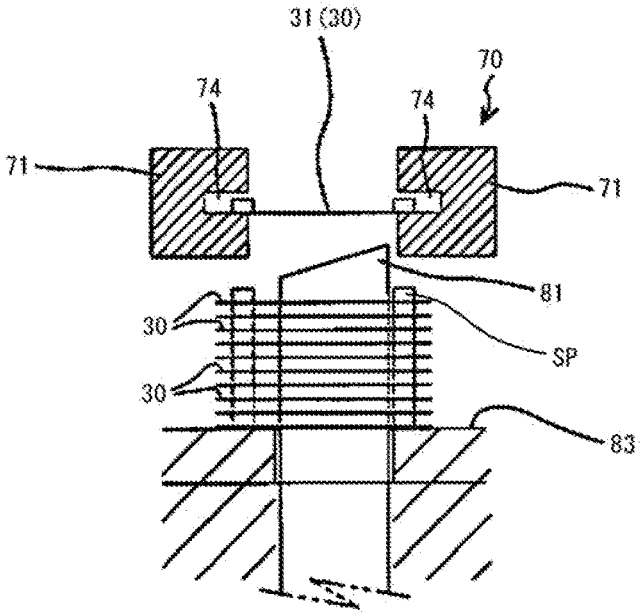
FIG. 4 is a front view of a principal part of the holding apparatus part in FIG. 3, when looking from the conveying destination side toward the conveying source side.

A cutting apparatus 66 is provided downstream of the feeder apparatus 62 inside each cutoff apparatus 60. The operation of the cutting apparatus 66 is controlled by the operation control unit 90, and by cutting a heat dissipation fin molding 31 into a predetermined size (that is, a predetermined length), a heat dissipation fin 30 is formed. Each cutting apparatus 66 has an upper blade 68 disposed on the upper surface side of the heat dissipation fin molding 31 and a lower blade 69 disposed on the lower surface side of the heat dissipation fin molding 31. By closing the upper blade 68 and the lower blade 69, each heat dissipation fin molding 31 is cut to a predetermined length in the conveying direction, thereby manufacturing a heat dissipation fin 30 as a product. On the downstream side of the cutoff apparatus 60, the holder apparatus 70 and the stacker apparatus 80 that stacks the manufactured heat dissipation fins 30 in the plate thickness direction (that is, the up-down direction) are provided as the stacker unit 100B as depicted in FIG. 3 and FIG. 4.

The holder apparatus 70 supports the heat dissipation fin molding 31, which has emerged from the downstream side of the cutoff apparatus 60 before cutting into a predetermined length in the conveying direction so that the heat dissipation fin molding 31 is capable of sliding in the conveying direction. In more detail, the holder apparatus 70 includes a pair of holders 71 that are arranged on both sides of a heat dissipation fin molding 31 in the width direction so as to hold both ends in the width direction of a heat dissipation fin molding 31 that has passed through the cutoff apparatus 60 but is yet to be cut. The holders 71 are each formed with a U-shaped cross-section in a direction perpendicular to the length direction (that is, the conveying direction) of the heat dissipation fin moldings 31. That is, when the pair of holders 71 are viewed from the conveying direction, as depicted in FIG. 4, concave portions 74 that are outwardly recessed in the width direction are formed facing each other. This holder apparatus 70 can maintain the holding state from before a heat dissipation fin molding 31 is cut until after the heat dissipation fin moldings 31 has been cut into a predetermined length by the cutting apparatus 66 to form a heat dissipation fin 30.

The pairs of holders 71 are provided so as to be capable of moving toward and away from each other in the horizontal direction between side positions to the sides of a heat dissipation fin molding 31 and holding positions where the heat dissipation fin molding 31 is held. A fluid cylinder 72 whose operation is controlled by the operation control unit 90, which will be described later, is provided as a holder opening/closing mechanism for opening and closing the pair of holders 71 (note that the fluid cylinder 72 is omitted from the drawings aside from FIG. 1).

The stacker apparatus 80 includes a stacker guide holding portion 82 in the form of a flat plate on which stacker blades 81 and stacker pins SP as stacker guides are erected, and a fin receiving portion 83 that contacts a lowest heat dissipation fin 30 out of the plurality of heat dissipation fins 30 through which the stacker blades 81 have been inserted. The stacker pins SP contact outer edges of the heat dissipation fins 30 in the width direction, and restrict the planar positions of the heat dissipation fins 30 stacked on the fin receiving portion 83.

The stacker blades 81 in the present embodiment have a size that enables the stacker blades 81 to be inserted through the cutout portions 34 of the heat dissipation fins 30, and in more detail are formed as thin plates whose long sides are in the width direction of the products so as to match the shape of the cutout portions 34. The upper ends of the stacker blades 81 may be formed as inclined tip portions 81A, which are slash-cut with respect to a central axis in the direction in which the stacker blades 81 are erected as in the present embodiment, or may be formed as a flat tip portions. Product side surface guides 81B in the form of flat plates are disposed at the base of the stacker blades 81. The product side surface guides 81B restrict the positions of the side surfaces of the heat dissipation fins 30 stacked on the fin receiving portion 83, and are provided at positions that are close to or contact edge portions in the width direction of the heat dissipation fins 30 (see FIG. 8).

Figure 5:
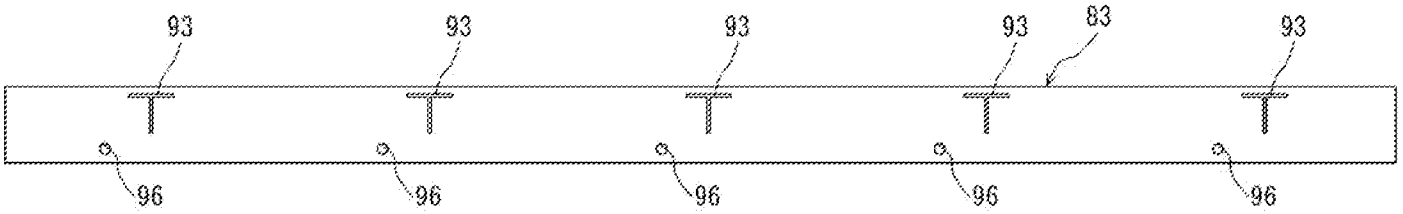
FIG. 5 is a plan view of a fin receiving portion.

Also, as depicted in FIG. 5, the fin receiving portion 83 in the present embodiment is formed of a rectangular plate with a flat upper surface for stacking the heat dissipation fins 30. Through-holes 93 for inserting the stacker blades 81 and the product side surface guides 81B, and a pin clearance portions 96 for inserting the stacker pins SP are formed in the fin receiving portion 83 at positions on a plane corresponding to the inserted components. On the other hand, the stacker guide holding portion 82 on which the stacker blades 81, the product side surface guides 81B, and the stacker pins SP are erected has a flat upper surface in the same way as the fin receiving portion 83.

Figure 6:
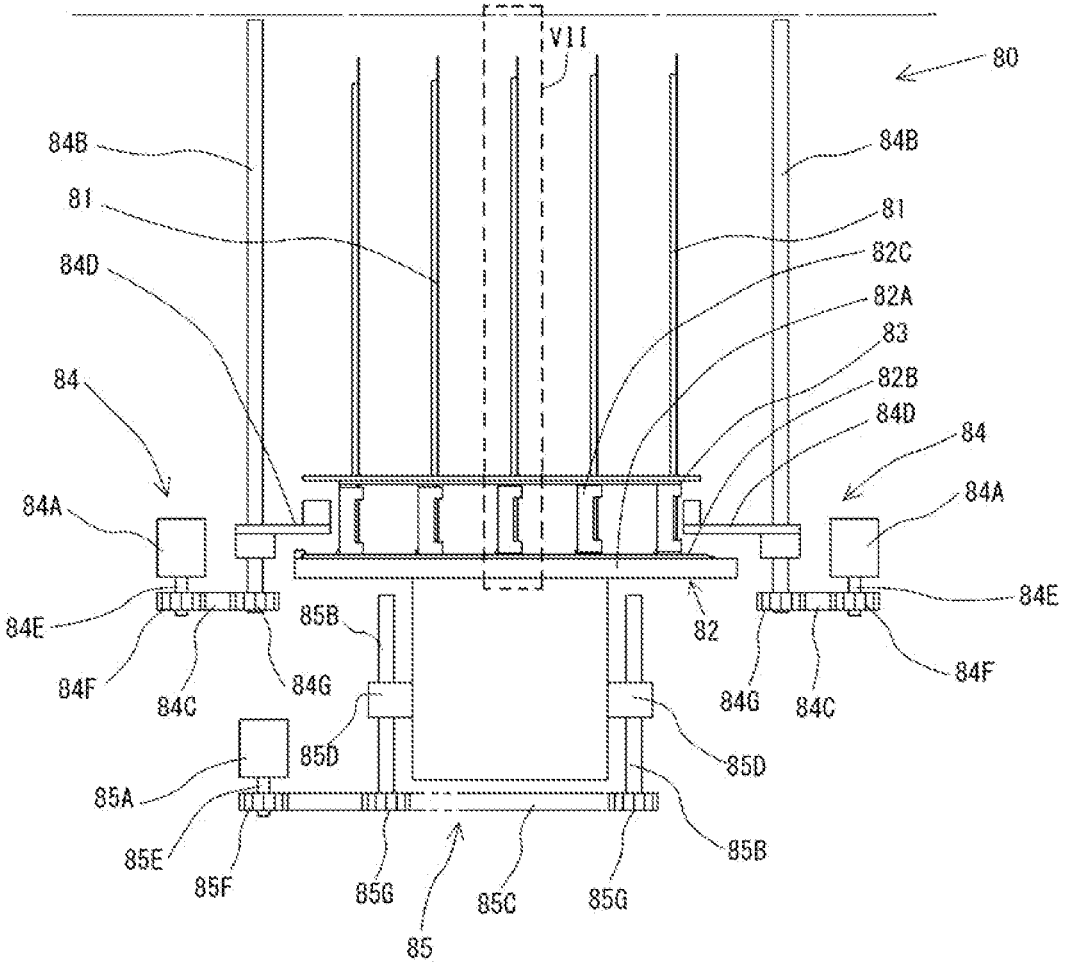
FIG. 6 is a side view of a principal part of the stacker apparatus in the present embodiment.

As depicted in FIG. 6, the stacker guide holding portion 82 in the present embodiment includes a pallet 82A as a base and magazines 82C to which a spacer 82B for holding the stacker blades 81 is fixed. The spacer 82B that holds the stacker blades 81 in an erected state is attached to the pallet 82A via the magazines 82C. Inside the stacker apparatus 80, the fin receiving portion 83 and the stacker guide holding portion 82 are capable of being independently moved up and down along the direction in which the stacker blades 81 are erected by first moving mechanisms 84 and a second moving mechanism 85. Note that the first moving mechanisms 84 corresponds to the "moving mechanism" referred to in the patent claims.

The first moving mechanisms 84 for moving the fin receiving portion 83 of the stacker apparatus 80 according to the present embodiment each includes a first servo motor 84A, a first ball screw 84B, a first timing belt 84C, and a raising/lowering plate 84D. The first ball screws 84B are provided in parallel to the direction in which the stacker blades 81 are erected. Each first timing belt 84C is suspended between a first timing pulley 84F attached to an output shaft 84E of a first servo motor 84A and a first driven timing pulley 84G attached to one end of the first ball screw 84B. Each raising/lowering plate 84D is attached by being screwed onto a first ball screw 84B and is provided so as to be capable of supporting the fin receiving portion 83. Each raising/lowering plate 84D can move up and down while supporting the fin receiving portion 83 along the axial direction of the first ball screw 84B (that is, along the direction in which the stacker blades 81 are erected) in keeping with the direction in which the first ball screw 84B is rotating.

The first moving mechanisms 84 in the present embodiment are provided at both ends in the length direction of the fin receiving portion 83 (which is the conveying direction of the heat dissipation fin moldings 31). The operation control unit 90 controls the operations of the first moving mechanisms 84 to synchronize with each other so that the upper surface of the fin receiving portion 83 is kept horizontal when the fin receiving portion 83 is raised and lowered.

Also, in the present embodiment, the second moving mechanism 85 that moves the stacker guide holding portion 82 includes a second servo motor 85A, second ball screws 85B, a second timing belt 85C, and raising/lowering platforms 85D. The second ball screws 85B are provided in parallel with the direction in which the stacker blades 81 are erected at a position below the stacker guide holding portion 82. The second timing belt 85C is suspended between a second timing pulley 85F that is attached to an output shaft 85E of the second servo motor 85A and second driven timing pulleys 85G that are attached to one end of each second ball screw 85B. The raising/lowering platforms 85D have end portions in the width direction that are attached by being screwed onto the second ball screws 85B, and an upper end of each raising/lowering platform 85D is attached to the stacker guide holding portion 82. The raising/lowering platform 85D is capable of moving the stacker guide holding portion 82 up and down along the axial direction of the second ball screws 85B (that is, along the direction in which the stacker blades 81 are erected) in keeping with the direction in which the second ball screws 85B are rotating.

The operation of the second moving mechanism 85 is controlled by the operation control unit 90 so that the second moving mechanism 85 operates independently of and in synchronization with the operation of the first moving mechanisms 84. Note that when synchronizing the operations of the second moving mechanism 85 and the first moving mechanisms 84, the respective operations are controlled by the operation control unit 90 so that the mutual positional relationship is maintained (that is, the relative positions of the second moving mechanism 85 and the first moving mechanisms 84 are maintained). The configuration of the second moving mechanism 85 can also be omitted, and it is possible to use a configuration where the second moving mechanism 85 is omitted and the stacker guide holding portion 82 is fixed. By including the second moving mechanism 85, it is possible to maintain a sufficient distance from the holders 71 to the stacker guide holding portion 82, which makes it possible to stack and collect a large number of heat dissipation fins 30. Also, by including the second moving mechanism 85, it is possible to replace (that is, move) the pallet 82A while avoiding drop guide pins 59. As described above, it is favorable to include the second moving mechanism 85 since the task of stacking and collecting the heat dissipation fins 30 becomes more efficient.

Figure 7:
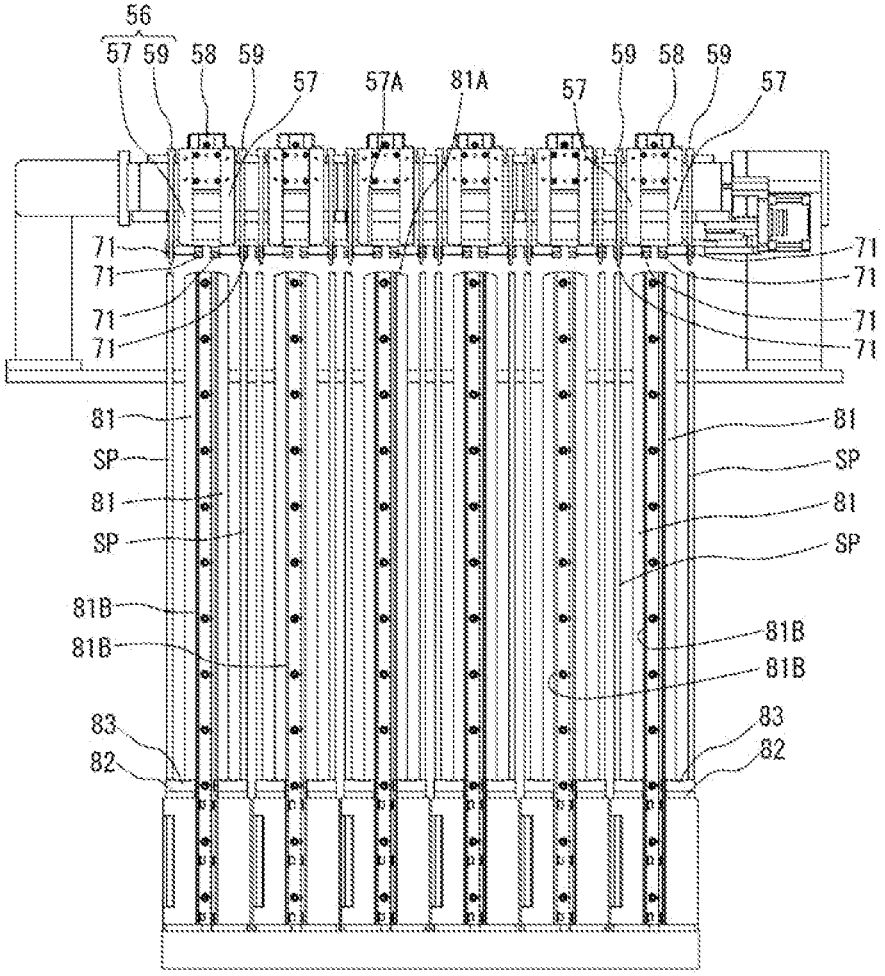
FIG. 7 is a front view of a part marked "VII" in FIG. 6 when looking from the conveying destination side to the conveying source side.

In the present embodiment, as depicted in FIG. 7, drop guiding apparatuses 56 are disposed to guide the heat dissipation fins 30 as the heat dissipation fins 30 drop during transfer from the holder apparatuses 70 to the stacker apparatuses 80.

Each drop guiding apparatus 56 in the present embodiment includes a drop guide blades 57 and drop guide pins 59 as drop guides, and a drop guide blade moving unit 58 as a drop guide moving unit. Like the stacker blades 81, the drop guide blades 57 in the present embodiment are formed with blade bodies that have inclined tip portions 57A, and are disposed in a state of being aligned at positions on a plane that enable the drop guide blades 57 to be inserted through the cutout portions 34. Here, the cutout portions 34 through which the stacker blades 81 are inserted and the cutout portions 34 through which the drop guide blades 57 are inserted do not need to be the same cutout portions 34 (see FIG. 8).

The drop guide blades 57 formed in this way can be raised and lowered between an upper position and a lower position in the holder apparatus 70 by the drop guide blade moving unit 58 that is disposed at an upper position in the holder apparatus 70 (that is, the drop guide blades 57 can be moved toward and away from the stacker apparatus 80). Although a fluid cylinder is used as the drop guide blade moving unit 58 in the present embodiment, it is also possible to use other configurations. Raising and lowering operations of the drop guide blades 57 by the drop guide blade moving unit 58 are controlled by the operation control unit 90.

The drop guide pins 59 are suspended at positions to the side of the drop guide blades 57. The drop guide pins 59 are disposed at positions where the outer peripheral surfaces of the drop guide pins 59 contact or almost contact one edge part in the width direction (that is, one side surface) of the heat dissipation fin moldings 31 (or heat dissipation fins 30), and are inserted through the clearance portion 96 parts formed in the holders 71. Each drop guide pin 59 is formed with small diameter portion in a predetermined range at the front tip portion which includes the part inserted through the holders 71. Lower end positions of the drop guide pins 59 are located below lower end positions of the drop guide blades 57 and at lower positions than the height positions of the tips of the stacker pins SP, so that the lower ends of the drop guide pins 59 and the upper ends of the stacker pins SP overlap in the height direction. By disposing the drop guide pins 59 at positions adjacent to the drop guide blades 57 like in the present embodiment, the positioning of the heat radiating fins 30 in the width direction by the drop guide blades 57 and the drop guide pins 59 can be made more precise.

Figure 9:
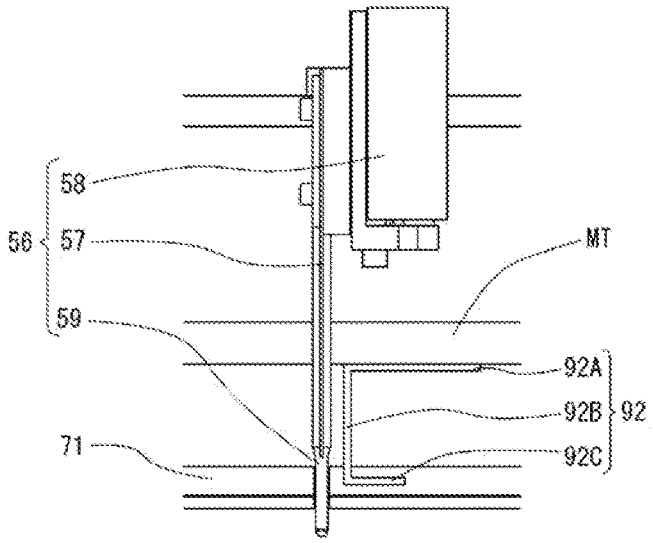
FIG. 9 is a diagram useful in explaining the overall structure of a stripper.

Also, as depicted in FIG. 9, the present embodiment further includes strippers 92 that are suspended from a mount MT from which the holder 71 is suspended. Each stripper 92 in the present embodiment is formed in a J shape including a mounting portion 92A that attaches to the mount MT, a hanging portion 92B that extends from the mount MT, and a contact portion 92C that contacts a heat dissipation fin 30. The length of the hanging portion 92B of the stripper 92 is adjusted so that the contact portion 92C is held at a position directly above and at a predetermined interval from a heat dissipation fin 30. By providing the strippers 92, when the drop guide blades 57 that were inserted through a heat dissipation fin 30 are withdrawn, even if the heat dissipation fin 30 is raised together with the drop guide blades 57, it is possible to separate the heat dissipation fin 30 at the positions of the contact portions 92C.

Figure 10:
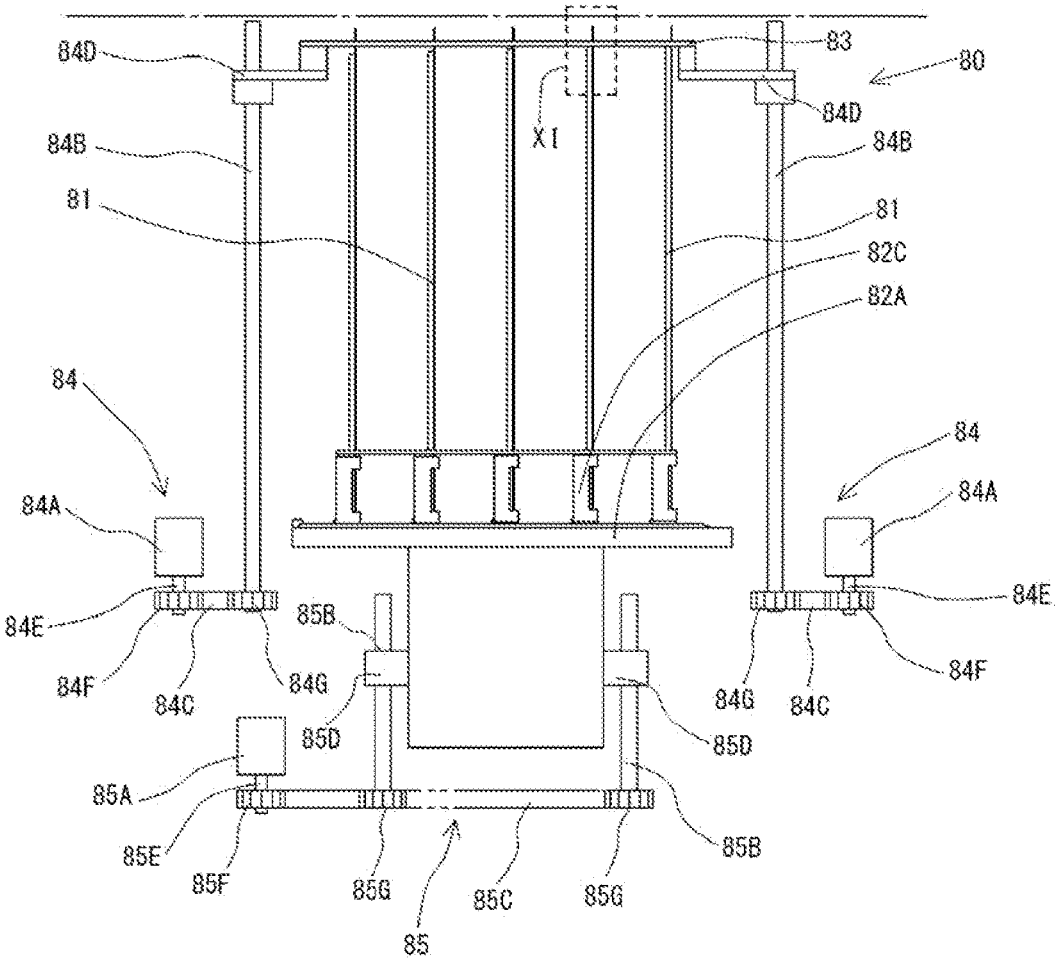
FIG. 10 is a side view of the stacker apparatus depicting a state where the fin receiving portion has been raised from the state depicted in FIG. 6.
Figure 11:
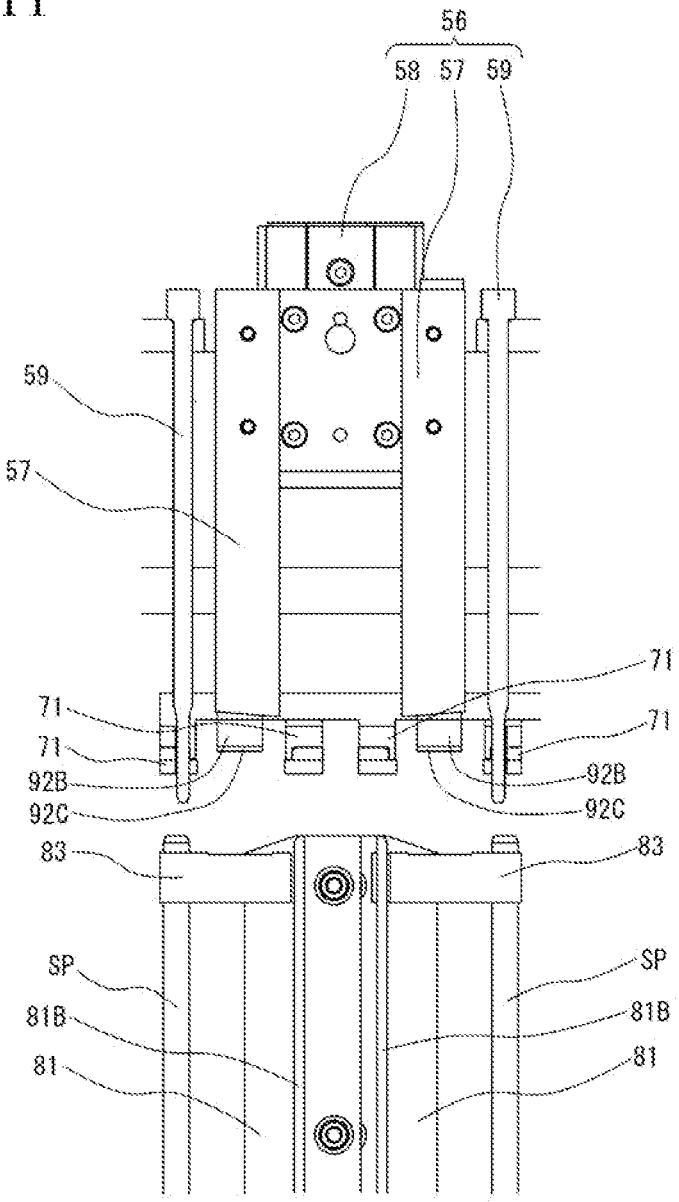
FIG. 11 is a front view of a part marked "XI" in FIG. 10 when looking from the conveying destination side toward the conveying source side.
Figure 12:
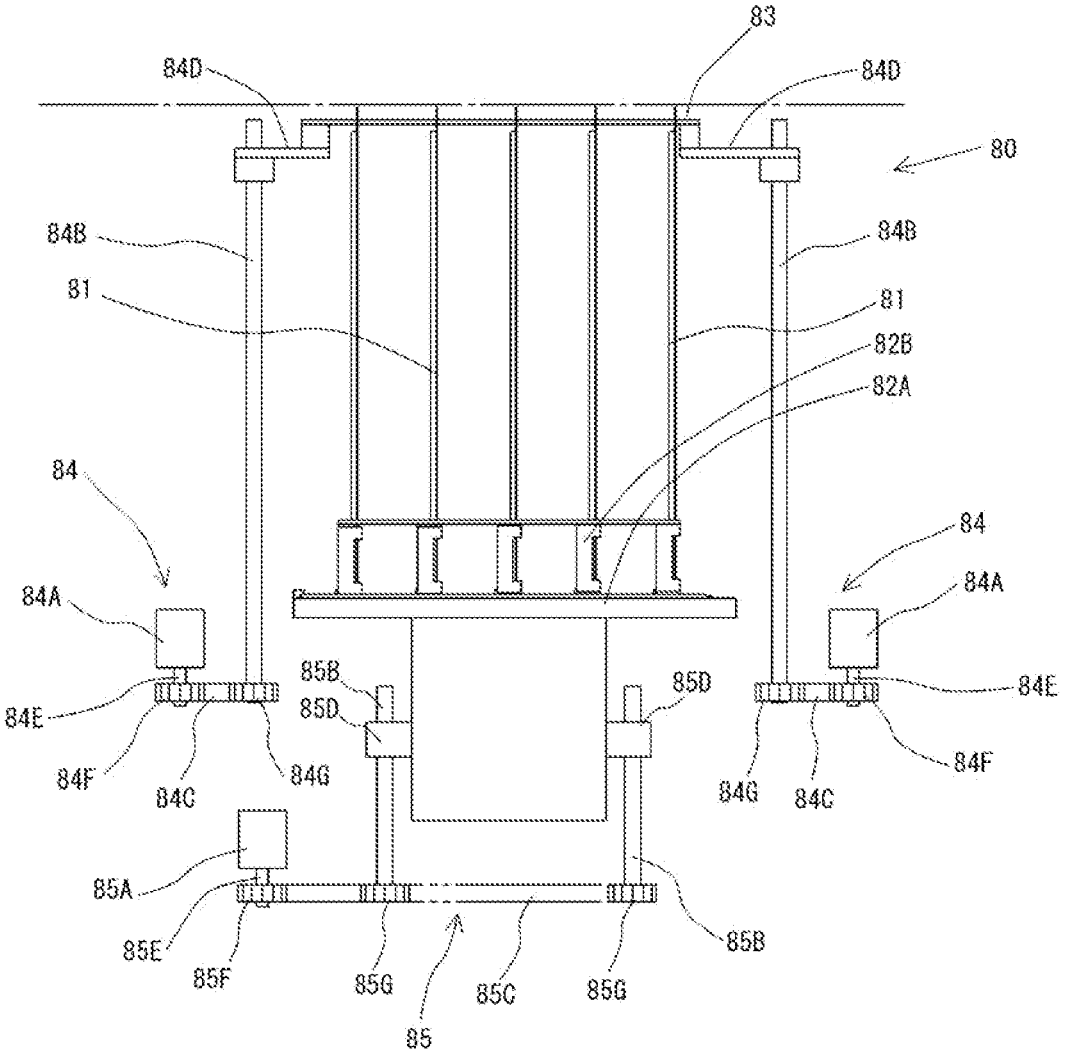
FIG. 12 is a side view of a principal part depicting a state where the stacker guide holder and the fin receiving portion have been raised in synchronization from the state depicted in FIG. 10 to a heat dissipation fin receiving height position.

Next, the operations of the holder apparatus 70 and the stacker apparatus 80, which are characteristic operations of the manufacturing apparatus for heat dissipation fins 100 according to the present embodiment, will be described in detail. When the stacker apparatus 80 moves from the initial position depicted in FIG. 6 to a standby position depicted in FIGS. 10 and 11, the operation control unit 90 operates the first moving mechanisms 84 to raise only the fin receiving portion 83 along the stacker blades 81 (standby for start of stacking and collection). After this, when an operation for stacking the heat dissipation fins 30 in the stacker apparatus 80 starts, the operation control unit 90 operates the first moving mechanisms 84. In the present embodiment, in addition to the first moving mechanisms 84, the second moving mechanism 85 is operated in a synchronized state. That is, as depicted in FIGS. 12 and 13, the fin receiving portion 83 and the stacker guide holding portion 82 are raised to a receiving height position for a heat dissipation fin 30 while maintaining the distance by which the stacker blades 81 and the stacker pins SP protrude from the upper surface of the fin receiving portion 83 (first process).

Figure 13:
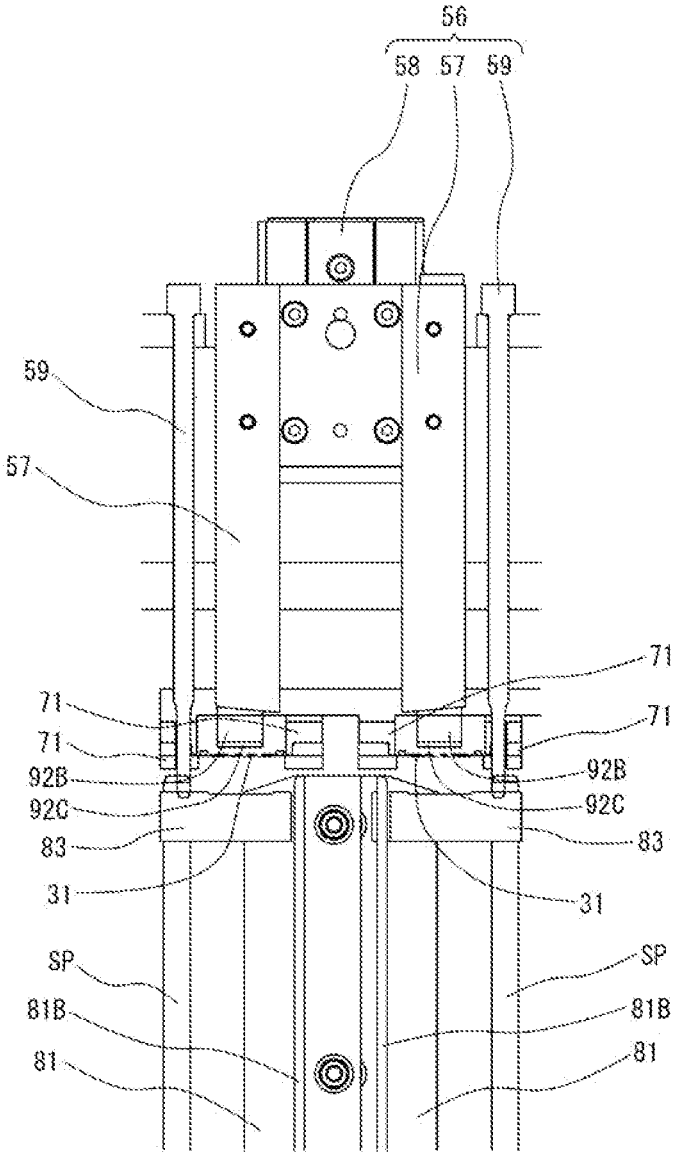
FIG. 13 is a view corresponding to FIG. 11 for the state in FIG. 12.

Next, the operation control unit 90 operates the conveying unit 64 of the cutoff apparatus 60 and, as depicted in FIG. 13, passes a predetermined length of the heat dissipation fin moldings 31 through the cutting apparatus 66 of the cutoff apparatus 60 (second process). Note that the dot-dash line in FIG. 12 indicates the pass line for a heat dissipation fin molding 31 (that is, the height position at which a heat dissipation fin 30 is transferred from a pair of holders 71 to the fin receiving portion 83).

Figure 14:
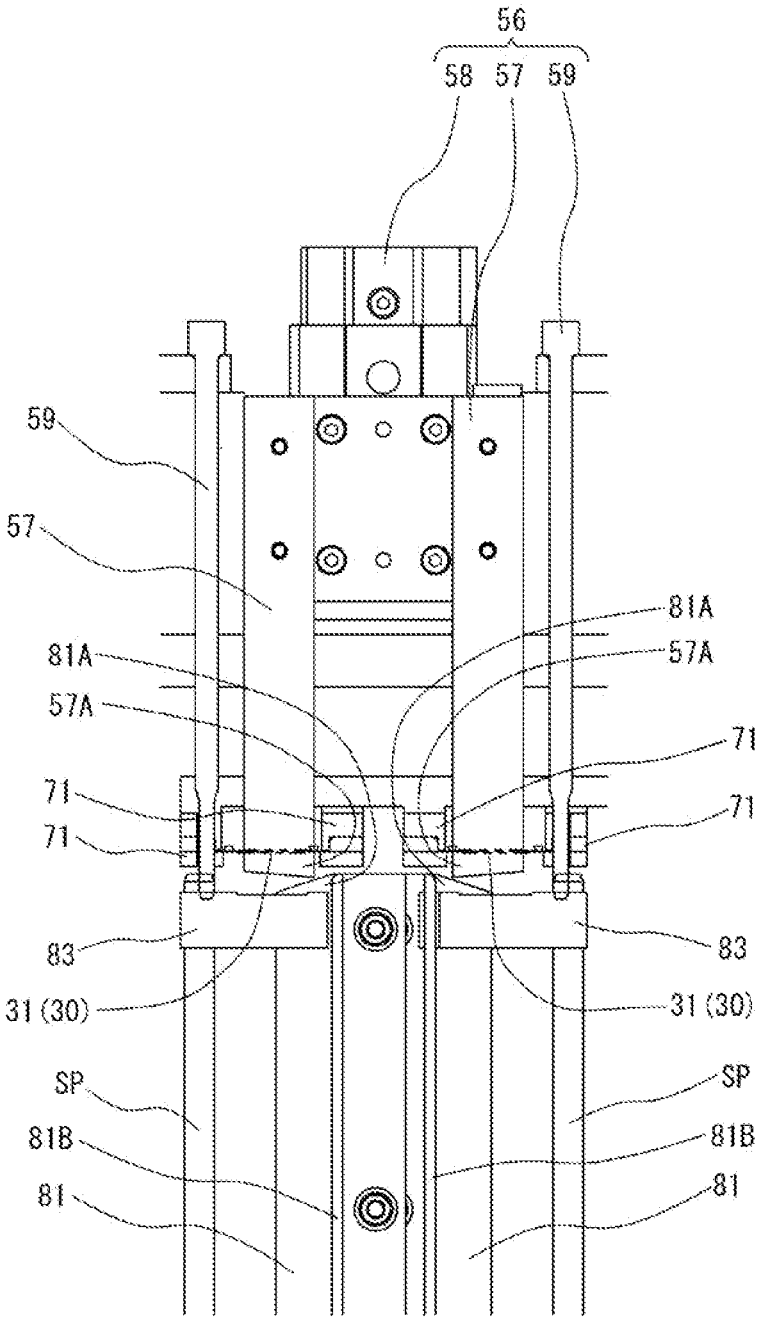
FIG. 14 is a view corresponding to FIG. 11 depicting a state where drop guides have been lowered to a position where the drop guides pass through a heat dissipation fin molding held by a pair of holders.

Next, as depicted in FIG. 14, the operation control unit 90 operates the drop guide blade moving unit 58 to lower the drop guide blades 57 from a position above the pair of holders 71 to a position where the drop guide blades 57 pass through the heat dissipation fin molding 31 held by the pair of holders 71. At this time, the drop guide blades 57 are inserted through the cutout portions 34 of the heat dissipation fin molding 31 and the inclined tip portions 57A are positioned just before a contact position with the inclined tip portions 81A (that is, the upper end portions) of the stacker blades 81 (third process). The heat dissipation fin molding 31 held in this state where the heat dissipation fin molding 31 is positioned in the width direction by the pair of holders 71 is also positioned in the conveying direction by the drop guide blades 57. In this state, the operation control unit 90 operates the cutting apparatus 66 to cut the heat dissipation fin molding 31 into a predetermined size in the conveying direction to produce one heat dissipation fin 30 (fourth process).

Figure 15:
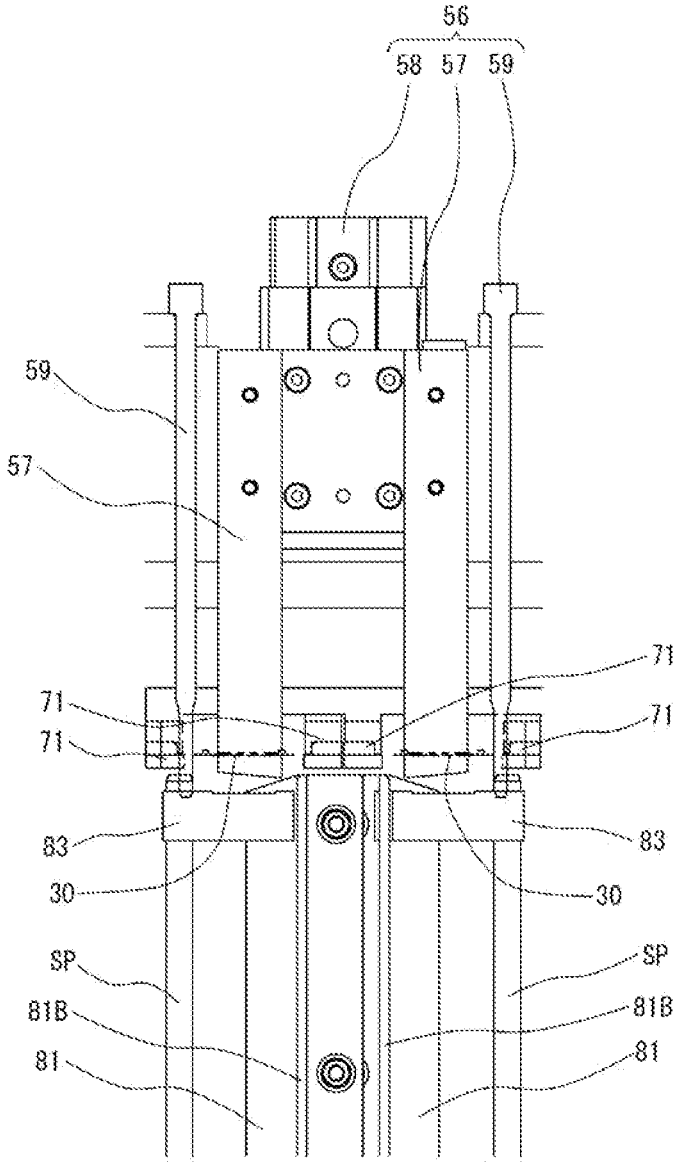
FIG. 15 is a view corresponding to FIG. 11 depicting a state where the pair of holders have been moved apart after cutting of the heat dissipation fin molding.
Figure 16:
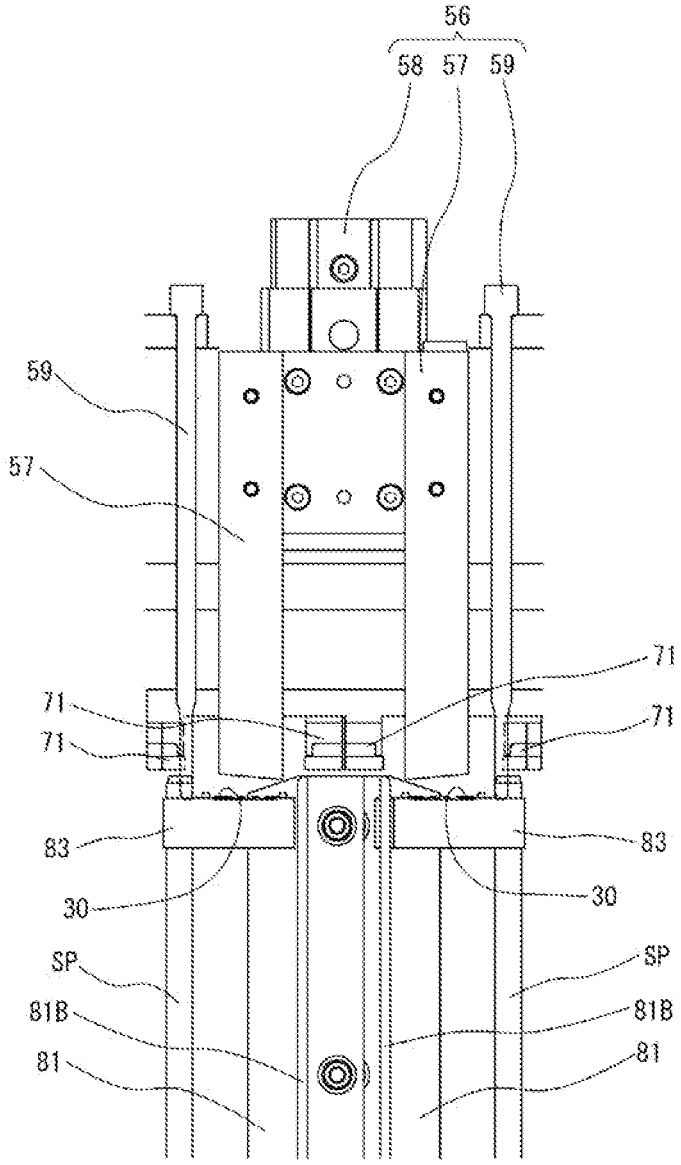
FIG. 16 is a view corresponding to FIG. 11 depicting a state where a heat dissipation fin has dropped from the pair of holders and been placed on the fin receiving portion along the stacker blades.

Next, the operation control unit 90 operates the fluid cylinder 72 to move the concave portions 74 of the pair of holders 71 away from each other as depicted in FIG. 15. At this time, since the drop guide pins 59 are in contact with the outer edges in the width direction of the heat dissipation fins 30, it is possible to restrict positional displacement of the heat dissipation fin 30 in the width direction. When the pair of holders 71 move apart, the heat dissipation fin 30 that was held by the pair of holders 71 drops along the drop guide blades 57 as depicted in FIG. 16 in a state where the heat dissipation fin 30 is positioned on a plane and is stacked in a state where the stacker blades 81 of the fin receiving portion 83 are inserted through the cutout portions 34 (fifth process).

Figure 17:
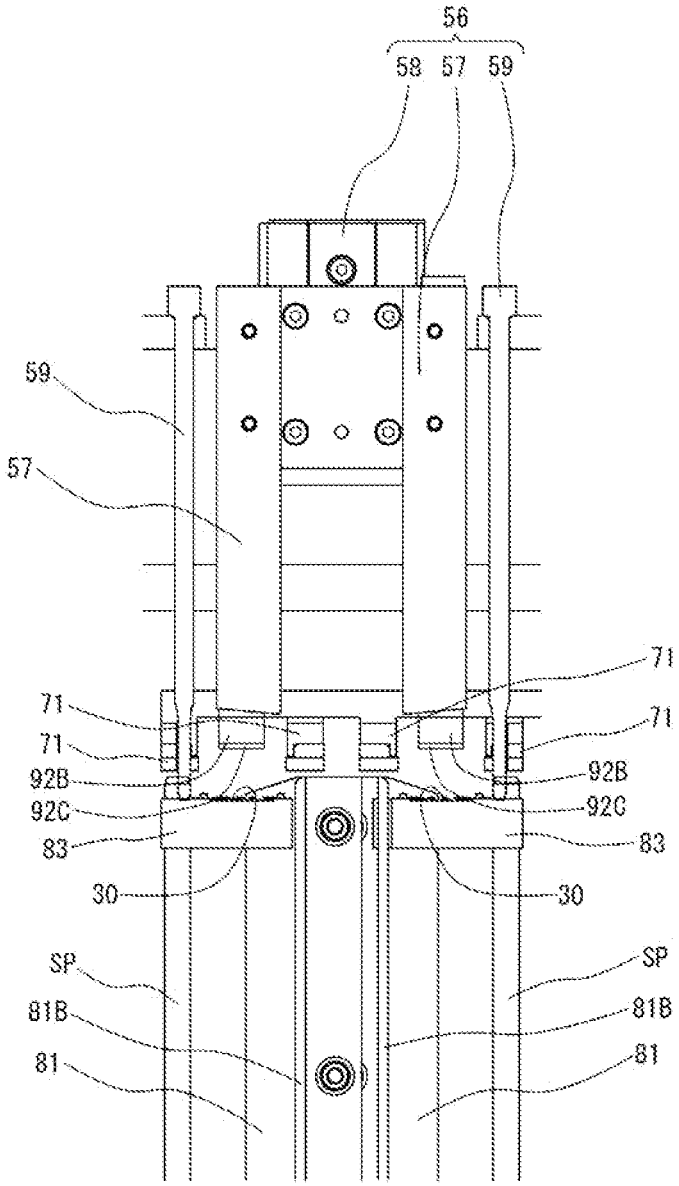
FIG. 17 is a view corresponding to FIG. 11 depicting a state where the drop guides have been withdrawn to a position above the pair of holders.

Next, the operation control unit 90 operates the drop guide blade moving unit 58 to withdraw the drop guide blades 57 to a position above the pair of holders 71 as depicted in FIG. 17 (sixth process). Note that the withdrawn position of the drop guide blades 57 may be any position above the pass line of the heat dissipation fin moldings 31 at a height that does not interfere with a heat dissipation fin molding 31 that is newly fed. As depicted in FIG. 17, at the same time as the sixth process, the operation control unit 90 in the present embodiment executes a process of returning the pair of holders 71 to positions where a heat dissipation fin molding 31 can be held.

Note that although the operation control unit 90 operates the fluid cylinder 72 to bring the pair of holders 71, which were moved apart, back together and return the holders 71 to positions where a heat dissipation fin molding 31 can be held when executing the sixth process, the present disclosure is not limited to this timing. The operation control unit 90 can also execute the process of returning the pair of holders 71, which were moved apart, to positions where a heat dissipation fin molding 31 can be held immediately before or immediately after the sixth process. In addition, the operation control unit 90 may execute the process of returning the pair of holders 71, which were moved apart, to positions where a heat dissipation fin molding 31 can be held as an eighth process which follows execution of a seventh process, described below.

Figure 18:
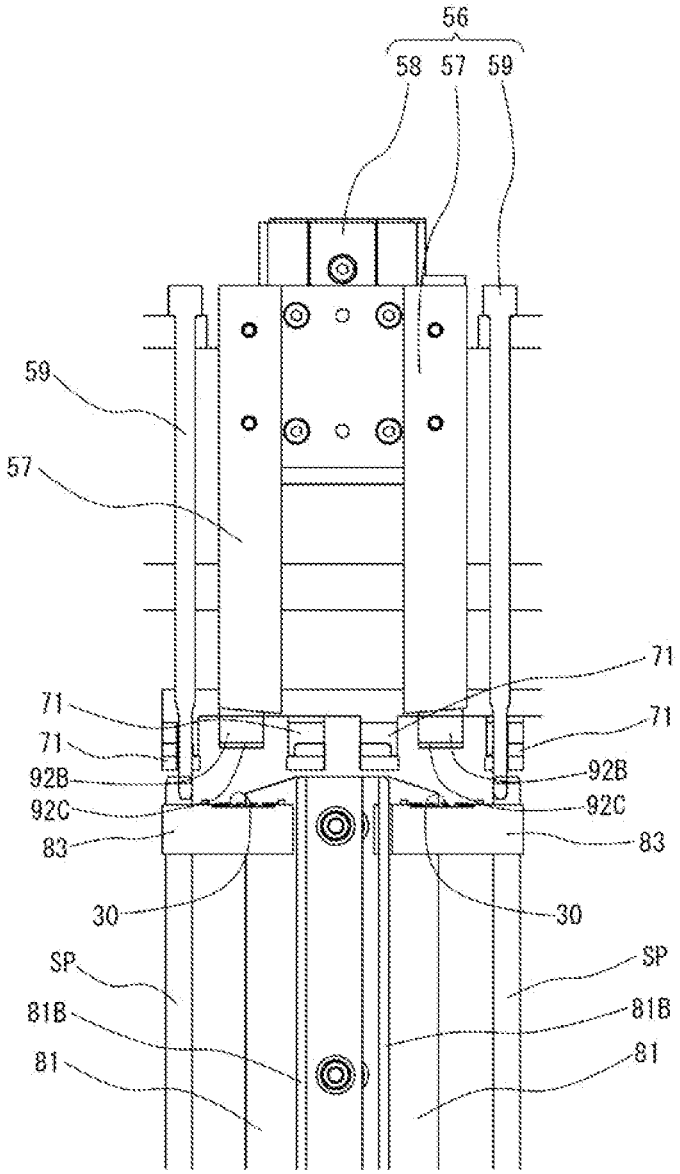
FIG. 18 is a view corresponding to FIG. 11 depicting a state where only the fin receiving portion has been lowered by a height corresponding to one heat dissipation fin.
Figure 19:
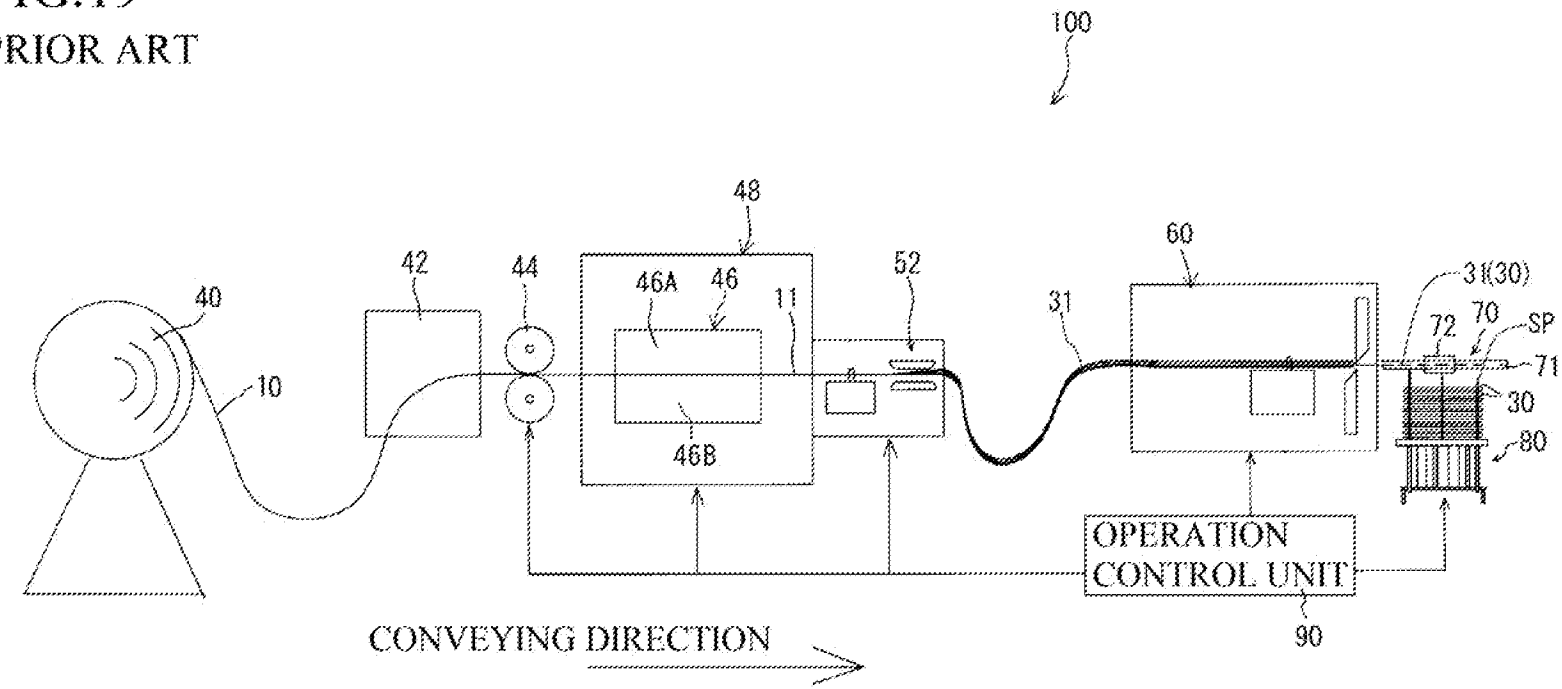
FIG.19 PRIOR ART
FIG. 19 is a side view depicting the schematic overall configuration of a conventional manufacturing apparatus for heat dissipation fins.
Figures 20A, 20B:
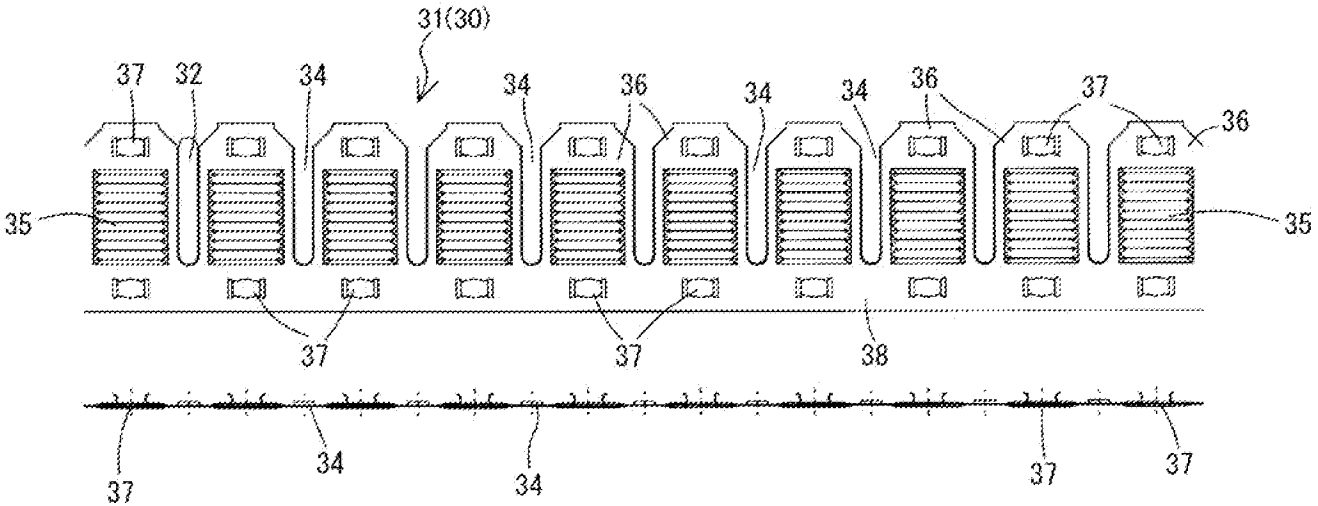
FIG. 20A is a plan view of a heat dissipation fin molding and FIG. 20B is a front view of the heat dissipation fin molding.

Next, the operation control unit 90 operates the first moving mechanisms 84 as depicted in FIG. 18 to lower the fin receiving portion 83 to a preset height (seventh process). The height to which the fin receiving portion 83 is lowered is the height of one heat dissipation fin 30 to be stacked. By doing so, it is possible to make the drop height of a heat dissipation fin 30 from the holder apparatus 70 to the fin receiving portion 83 constant.

In addition, at the same time as the fifth process, immediately before the fifth process, or after the fifth process, the operation control unit 90 performs a process that adds one to a counter value (whose numeric value is reset to zero at the start of stacking of the heat dissipation fins 30) of a stacked number of heat dissipation fins 30 stored in advance in a storage unit (not illustrated). Next, the operation control unit 90 executes a process (or "stacked number checking process") that compares the counter value of the number of stacked fins with a comparison target value stored in advance in a storage unit, which is also not illustrated. When the comparison target value>the counter value of the number of stacked fins, the operation control unit 90 executes a process of returning to the second process, and repeatedly executes the processing up to the stacked number checking process.

When, in the stacked number checking process, the comparison target value equals the counter value of the number of stacked fins, the following processing is executed. That is, the operation control unit 90 executes a process (or "stack removal moving process") that moves the stack of heat dissipation fins 30, the fin receiving portion 83, and the stacker guide holding portion 82 to a stack delivery position using a stacker apparatus moving mechanism, not illustrated. After this, the operation control unit 90 executes a process (or "stack removal process") that removes the stack of heat dissipation fins 30 from the stacker apparatus 80 using a stack removing apparatus, not illustrated. Next, the operation control unit 90 resets the counter value of the number of stacked fins in the storage unit to zero, and then executes a process (or "stacker apparatus return process") that operates the stacker apparatus moving mechanism to return the stacker apparatus 80 to its original position. Note that the stacker apparatus return process can be replaced with a process of attaching a separate fin receiving portion 83 and stacker guide holding portion 82.

After this, the operation control unit 90 executes a process (or "standby state transition process") that operates the first moving mechanisms 84 to raise the fin receiving portion 83 to a stacking start reference height position, and then repeats the same processing from the first process onward in the same way as described above. Note that although the fin receiving portion 83 is raised from the initial state of the stacker apparatus 80 as the standby state transition process, the state after the standby state transition process may be regarded as the initial state.

With the configuration of the manufacturing apparatus for heat dissipation fins 100 according to the present embodiment, when the heat dissipation fins 30 are stacked and collected in the stacker apparatus 80, operations that lift the stacker guide holding portion 82, which is heavy, are minimized. By doing so, the consumption of electrical energy by the stacker apparatus 80 when stacking and collecting the heat dissipation fins 30 is reduced, which reduces the operating cost. Also, after a heat radiation fin 30 has been stacked on the fin receiving portion 83, the fin receiving portion 83 only moves downward, which makes it possible to perform stacking operations of the heat dissipation fins 30 in a stable state.

Also, in the manufacturing apparatus for heat dissipation fins 100 according to the present embodiment, since the stacker apparatus 80 does not pick up the heat dissipation fins 30 from below, it is not necessary to provide a function for positioning the stacker pins SP, so that the stacker pins SP can be make thicker, thereby increasing the rigidity of the stacker pins SP. This is also advantageous in that the stack of heat dissipation fins 30 stacked and housed in the stacker apparatus 80 can be handled in a stable state.

The heat dissipation fins 30 can be dropped from the pair of holders 71 to the fin receiving portion 83 with the smallest possible drop. The heat dissipation fins 30 can be stacked and collected in the stacker apparatus 80 in a state of being positioned by the drop guide blades 57 and stacker blades 81 and by the drop guide pins 59 and stacker pins SP.

Note that although the manufacturing apparatus for heat dissipation fins 100 according to the present embodiment described above manufactures a plurality of heat dissipation fins 30 in parallel in the width direction on the unmachined thin metal plate 10 and therefore includes the inter-row slit apparatus 52, the configuration is not limited to this. In a case where a thin metal plate 10 formed in the shape of an elongated strip is used and one heat radiation fin 30 is formed in the width direction of the thin plate 10, the configuration of the inter-row slit apparatus 52 can be omitted.

Also, when the configuration of the second moving mechanism 85 is omitted from the configuration of the above embodiment, the stacker guide holding portion 82 is completely fixed, and raising operations of the stacker guide holding portion 82 can be eliminated. When this configuration is used, only the first moving mechanisms 84 operate in the first process, and only the fin receiving portion 83 is raised to the receiving height position of the heat dissipation fins 30. By doing so, the configuration of the stacker apparatus 80 can be simplified and the consumption of electrical energy can be further reduced, which means the operating cost can be further reduced.

Although the drop guides in the embodiment described above include the drop guide blades 57 and the drop guide pins 59, the configuration of the drop guide pins 59 can be omitted.

In addition, although the holders 71 that are U-shaped in cross-section are described in the embodiment described above, the holders 71 may be any form that includes at least a bottom surface and side surfaces as the concave portions 74 that are recessed toward the outside in the width direction. In more detail, it is possible to use a configuration where the holders 71 are formed with an L-shaped cross section or a C-shaped cross section.

Although the holders 71 have been described above as being continuous in the conveying direction of the metal strip 11, a configuration where a plurality of pairs of holders that are formed with required lengths along the length direction of the heat dissipation fins 30 are disposed at predetermined intervals may be used. By disposing the drop guide pins 59 so as to advance into the intervals between the holders 71, it is possible to prevent the drop guide pins 59 from interfering with the holders 71.

In addition, although the manufacturing apparatus for heat dissipation fins 100 in the above embodiment uses the fluid cylinder 72 as a means for opening and closing the holders 71, so long as the holders 71 can be moved, the configuration is not particularly limited to the fluid cylinder 72. In addition, an embodiment where the first servo motor 84A and the second servo motor 85A, and the first ball screw 84B and the second ball screw 85B connected via the first timing pulley 84F and the second timing pulley 85F and the first timing belt 84C and the second timing belt 85C, to the output shafts 84E and 85E of the first servo motor 84A and the second servo motor 85A are used as the first moving mechanisms 84 and the second moving mechanism 85 is described in the present specification. However, the present invention is not limited to the first moving mechanisms 84 (and the second moving mechanism 85) having the configurations described above.

Figure 8:
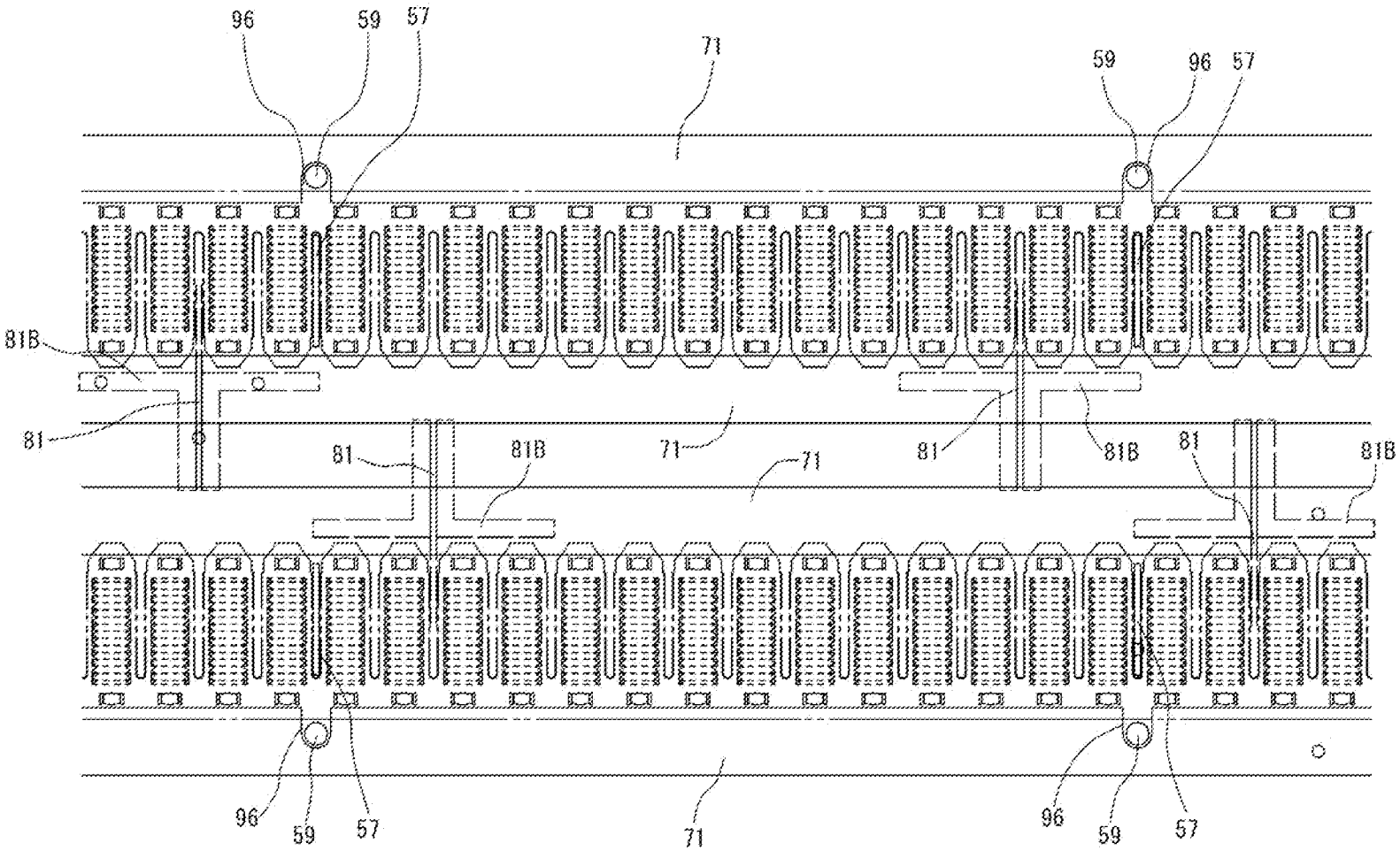
FIG. 8 is a plan view of a principal part from above the holders in FIG. 7.

Although the drop guide pins 59 in the present embodiment are disposed as depicted in FIG. 8 in keeping with the drop guide blades 57 at positions on lines produced by extending the length direction of the cutout portions 34 into which the drop guide blades 57 advance, the present invention is not limited to this configuration. It is also possible to use a configuration where a drop guide blade 57 and a drop guide pin 59 are disposed at positions that are not on a line produced by extending the length direction of a cutout portion 34.

It is also possible for a manufacturing apparatus for heat dissipation fins 100 to use a configuration in which the various modifications described in this specification have been appropriately combined.

What is claimed is:

1. A manufacturing apparatus for heat dissipation fins comprising:

a press apparatus provided with a mold apparatus that forms cutout portions in an unmachined metal thin plate, the unmachined metal thin plate having been supplied from a material supplying unit, to form a heat dissipation fin molding;

a conveying apparatus that supplies the thin plate to the press apparatus and conveys the heat dissipation fin molding from the press apparatus;

a cut-off apparatus that cuts the heat dissipation fin molding into a predetermined length to form a heat dissipation fin;

a holder apparatus including: a pair of holders that hold the heat dissipation fin molding and the heat dissipation fin and are capable of moving together and apart between positions to a side of the heat dissipation fin molding, the heat dissipation fin molding having passed through the cutoff apparatus and protruding in a conveying direction from the cutoff apparatus, and holding positions for holding the heat dissipation fin molding; and a holder opening/closing mechanism that moves the pair of holders together and apart;

a stacker apparatus that is disposed below the holder apparatus to stack heat dissipation fins that have been cut into a predetermined length by the cutoff apparatus and includes: a stacker guide holder unit on which a stacker guide, the stacker guide having been inserted through the heat dissipation fin held by the holder apparatus, is erected; a fin receiving portion that contacts a lower surface of a lowest heat dissipation fin out of the heat dissipation fins through which the stacker guide passes through; and a moving mechanism that moves the fin receiving portion along the stacker guide;

a drop guide apparatus including: a drop guide disposed above the pair of holders at a position on a plane that enables the drop guide to be inserted into one of the cutout portions; and a drop guide moving unit that moves the drop guide toward and away from the stacker apparatus; and an operation control unit that controls respective operations of at least the cutoff apparatus, the holder apparatus, the stacker apparatus, and the drop guide apparatus.

2. The manufacturing apparatus for heat dissipation fins according to claim 1, wherein the operation control unit executes:

a first process that operates, when the pair of holders are at holding positions where the heat dissipation fin molding can be held, the moving mechanism to raise the fin receiving portion to a receiving height position for a heat dissipation fin;

a second process that operates the conveying apparatus to cause the predetermined length of the heat dissipation fin molding to pass through the cutoff apparatus;

a third process that operates the drop guide moving unit to insert the drop guide through a cutout portion in the heat dissipation fin molding and place a lower end portion of the drop guide close to an upper end portion of the stacker guide until the heat dissipation fin molding held by the pair of holders is cut by the cutoff apparatus into the heat dissipation fin;

a fourth process that cuts the heat dissipation fin molding into a predetermined size using the cutoff apparatus;

a fifth process that operates the holder opening/closing mechanism to move the pair of holders apart to transfer the heat dissipation fin along the drop guide onto the fin receiving portion;

a sixth process that operates, after the heat dissipation fin has been transferred onto the fin receiving portion from the pair of holders, the drop guide moving unit to withdraw the lower end portion of the drop guide to a position above the pair of holders; and a seventh process that operates the moving mechanism to lower the fin receiving portion to a preset height.

3. The manufacturing apparatus for heat dissipation fins according to claim 2, wherein after the sixth process has been executed, the operation control unit executes an eighth process that operates the holder opening/closing mechanism to return the pair of holders to the holding positions.

4. The manufacturing apparatus for heat dissipation fins according to claim 3, wherein after the eighth process is executed, the operation control unit returns to the first process and repeatedly executes the first process to the eighth process for a preset number of iterations.

5. The manufacturing apparatus for heat dissipation fins according to claim 2, wherein the operation control unit executes the first process and the second process simultaneously.

6. The manufacturing apparatus for heat dissipation fins according to claim 2, wherein the stacker guide includes a stacker blade that is inserted through a cutout portion and a stacker pin that contacts an outer edge of the heat dissipation fin, wherein the drop guide is a drop guide blade that is inserted through the cutout portion, and wherein the drop guide moving unit moves the drop guide blade toward and away from the stacker apparatus.

7. The manufacturing apparatus for heat dissipation fins according to claim 2, wherein the drop guide includes a drop guide pin that is provided at a position which is capable of contacting or at a predetermined interval from an outer edge of the heat dissipation fin.

8. The manufacturing apparatus for heat dissipation fins according to claim 2, further comprising a stripper that prevents the heat dissipation fin from being raised together with the drop guide when the drop guide is moved away from the stacker apparatus.

9. The manufacturing apparatus for heat dissipation fins according to claim 1, wherein the operation control unit executes:

a first process of operating the conveying apparatus, when the pair of holders are at holding positions where the heat dissipation fin molding can be held, to cause the predetermined length of the heat dissipation fin molding to pass through the cutoff apparatus;

a second process of operating the moving mechanism to raise the fin receiving portion to a receiving height position for a heat dissipation fin;

a third process that operates the drop guide moving unit to insert the drop guide through a cutout portion in the heat dissipation fin molding and place a lower end portion of the drop guide close to an upper end portion of the stacker guide until the heat dissipation fin molding held by the pair of holders is cut by the cutoff apparatus into the heat dissipation fin;

a fourth process that cuts the heat dissipation fin molding into a predetermined size using the cutoff apparatus;

a fifth process that operates the holder opening/closing mechanism to move the pair of holders apart to transfer the heat dissipation fin along the drop guide onto the fin receiving portion;

a sixth process that operates, after the heat dissipation fin has been transferred onto the fin receiving portion from the pair of holders, the drop guide moving unit to withdraw the lower end portion of the drop guide to a position above the pair of holders; and a seventh process that operates the moving mechanism to lower the fin receiving portion to a preset height.

10. The manufacturing apparatus for heat dissipation fins according to claim 9, wherein after the sixth process has been executed, the operation control unit executes an eighth process that operates the holder opening/closing mechanism to return the pair of holders to the holding positions.

11. The manufacturing apparatus for heat dissipation fins according to claim 10, wherein after the eighth process is executed, the operation control unit returns to the first process and repeatedly executes the first process to the eighth process for a preset number of iterations.

12. The manufacturing apparatus for heat dissipation fins according to claim 9, wherein the operation control unit executes the first process and the second process simultaneously.

13. The manufacturing apparatus for heat dissipation fins according to claim 9, wherein the stacker guide includes a stacker blade that is inserted through a cutout portion and a stacker pin that contacts an outer edge of the heat dissipation fin, wherein the drop guide is a drop guide blade that is inserted through the cutout portion, and wherein the drop guide moving unit moves the drop guide blade toward and away from the stacker apparatus.

14. The manufacturing apparatus for heat dissipation fins according to claim 9, wherein the drop guide includes a drop guide pin that is provided at a position which is capable of contacting or at a predetermined interval from an outer edge of the heat dissipation fin.

15. The manufacturing apparatus for heat dissipation fins according to claim 9, further comprising a stripper that prevents the heat dissipation fin from being raised together with the drop guide when the drop guide is moved away from the stacker apparatus.

16. The manufacturing apparatus for heat dissipation fins according to claim 1, wherein the stacker guide includes a stacker blade that is inserted through a cutout portion and a stacker pin that contacts an outer edge of the heat dissipation fin, wherein the drop guide is a drop guide blade that is inserted through the cutout portion, and wherein the drop guide moving unit moves the drop guide blade toward and away from the stacker apparatus.

17. The manufacturing apparatus for heat dissipation fins according to claim 1, wherein the drop guide includes a drop guide pin that is provided at a position which is capable of contacting or at a predetermined interval from an outer edge of the heat dissipation fin.

18. The manufacturing apparatus for heat dissipation fins according to claim 1, further comprising a stripper that prevents the heat dissipation fin from being raised together with the drop guide when the drop guide is moved away from the stacker apparatus.

* * * * *